US005350668A

United States Patent [19]

Abe et al.

[11] Patent Number: 5,350,668

[45] Date of Patent: * Sep. 27, 1994

[54] METHOD FOR PROCESSING SILVER HALIDE COLOR PHOTOGRAPHIC MATERIAL CONTAINING TABULAR SILVER IODOBROMIDE GRAINS USING A PROCESSING SOLUTION HAVING A BLEACHING ABILITY CONTAINING AN IRON (III) COMPLEX SALT

[75] Inventors: Akira Abe; Hiroyuki Seki; Hisashi Okada; Tadashi Inaba, all of Kanagawa, Japan

[73] Assignee: Fuji Photo Film Co., Ltd., Kanagawa, Japan

[ * ] Notice: The portion of the term of this patent subsequent to Oct. 5, 2010 has been disclaimed.

[21] Appl. No.: 53,198

[22] Filed: Apr. 28, 1993

[30] Foreign Application Priority Data

Apr. 28, 1992 [JP] Japan ..... 4-134535

[51] Int. Cl.[5] ..... G03C 7/00; G03C 5/42; G03C 5/44; G03C 1/005

[52] U.S. Cl. ..... 430/393; 430/430; 430/460; 430/461; 430/567; 430/955

[58] Field of Search ..... 430/418, 430, 460, 461, 430/393, 544, 367

[56] References Cited

U.S. PATENT DOCUMENTS

| | | | |
|---|---|---|---|
| 4,863,837 | 9/1989 | Kurematsu et al. | 430/429 |
| 4,914,014 | 4/1990 | Daubendiek et al. | 430/567 |
| 4,959,299 | 9/1990 | Sakanoue et al. | 430/544 |
| 5,009,985 | 4/1991 | Kunitz et al. | 430/430 |
| 5,135,839 | 8/1992 | Szajewski | 430/544 |
| 5,149,618 | 9/1992 | Tappe et al. | 430/430 |
| 5,188,927 | 2/1993 | Okada et al. | 430/430 |
| 5,217,855 | 6/1993 | Okada et al. | 430/430 |
| 5,223,379 | 6/1993 | Okada et al. | 430/460 |
| 5,250,401 | 10/1993 | Okada et al. | 430/460 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method for processing a silver halide color photographic material comprising a support having thereon at least one silver halide emulsion layer which comprises subjecting the silver halide color photographic material to imagewise exposure and color development, and then processing with a processing solution having bleaching ability, wherein the silver halide emulsion layer contains silver halide grains having a composition such that tabular silver iodobromide grains having an aspect ratio of not higher than 3 account for at least 50% of the entire projected area of the silver halide grains, and the processing solution having bleaching ability contains as a bleaching agent an iron(III) complex salt of a compound having the described structural formula, used in a concentration of 0.01 to 0.17 mol/-liter.

20 Claims, No Drawings

METHOD FOR PROCESSING SILVER HALIDE COLOR PHOTOGRAPHIC MATERIAL CONTAINING TABULAR SILVER IODOBROMIDE GRAINS USING A PROCESSING SOLUTION HAVING A BLEACHING ABILITY CONTAINING AN IRON (III) COMPLEX SALT

FIELD OF THE INVENTION

This invention relates to a method for processing a silver halide color photographic material, and more particularly to an improved method for processing a silver halide color photographic material which is excellent in desilverization performance and reduces problems of water pollution.

BACKGROUND OF THE INVENTION

Water pollution caused by processing solutions in the processing of silver halide color photographic materials is presently a most important problem needing to be solved.

On the other hand, there is a demand for the shortening of processing time in order to provide rapid processing services to customers.

Iron(III) complex salts of aminopolycarboxylic acids, such as, iron(III) complex salts of ethylenediaminetetraacetic acid, and diethylenetriaminepentaacetic acid are used as bleaching agents in bleaching solutions and in bleaching-fixing solutions having the ability to bleach. The concentrations of the complex salts are usually 0.25 to 0.5 mol/l when color photographic materials are processed.

The discharge of such soluble salts, as mentioned above, is restrained in many water areas, because of the coloration of water, etc.

The decomposition speed of ethylenediaminetetraacetic acid by microorganisms in the natural environment is slow. For this reason, the discharge of this compound is restrained in some water areas in Europe. Accordingly, great care is taken in the art to reduce the discharged amounts of the iron(III) complex salts of the aminopolycarboxylic acids.

Attempts have been made to reduce the discharge amounts thereof. For example, methods have been proposed wherein:

- the replenishment rates of processing solutions are reduced;
- the waste liquors of the processing solutions are reclaimed or regenerated and reused;
- the concentrations of the iron(III) complex salts of the aminopolycarboxylic acids are reduced; and
- combinations of the foregoing methods.

Among the above methods, the reduction of the concentrations of the iron(III) complex salts of the aminopolycarboxylic acids in the processing solutions having bleaching ability is more effective in comparison with any combination of the other methods, and considered to be the most basic method.

From this standpoint, the present inventors have made studies to reduce the concentrations of the iron(III) complex salts of conventional aminopolycarboxylic acids, such as, iron(III) complex salts of ethylenediaminetetraacetic acid, diethylenetriaminepentaacetic acid, 1,3-diaminopropanetetraacetic acid, and cyclohexanediaminetetraacetic acid. It has been found that, when the concentrations of any of the above iron (III) complex salts are lowered, lower bleaching performance results, and the lowering of bleaching performance is remarkable particularly when color light-sensitive materials containing silver halide emulsions comprising tabular silver iodobromide grains are processed; it has also been found that when the concentrations of the above iron(III) complex salts are lowered, it is also difficult to conduct bleaching in a short period of time. Further, the present inventors have found that when the concentrations of the iron(III) complex salts of the aminopolycarboxylic acids are reduced to 0.2 mol/l or lower, the bleaching of the developed silver of tabular silver iodobromide grains is extremely deteriorated, and a failure in desilverization is caused. Furthermore, it has been found that a failure in the restoration of cyan dye is also liable to be caused.

Tabular silver iodobromide grains can improve sensitivity without detriment to image quality. The details thereof are described in *Research Disclosure* 22534, and tabular silver iodobromide grains have been widely used practically in high-sensitivity color negative films in recent years.

U.S. Pat. No. 4,552,834, JP-A-61-17143 (the term "JP-A" as used herein means an "unexamined published Japanese patent application"), JP-A-62-91953 and JP-A-2-46448 disclose that when emulsions comprising tabular silver iodobromide grains having a high aspect ratio are coated, the bleaching of the resulting color light-sensitive materials is made difficult. These references further disclose that this difficulty is mainly due to the fact that a large amount of sensitizing dye deposited on the tabular silver iodobromide grains and interferes with the bleaching reaction.

To solve the above-described problem, there have been proposed aromatic amine bleaching accelerators, such as, 1,3-phenylenediaminebis(2,2'-iminodiethanol), in the aforesaid U.S. Patent; bleaching-fixing solutions containing (ethylenediaminetetraacetato)iron(III) complex salts in JP-A-61-17143; the use of a combination of a bath having a bleaching ability with a bath having a bleaching-fixing ability, in JP-A-62-91953; and bleaching baths containing (1,3-diaminopropanetetraacetato)iron(III) complex salts or (1,4-diaminobutanetetraacetato)iron(III) complex salts as bleaching agents in an amount of at least 0.2 mol/l, in JP-A-2-46448 and JP-A-4-43347.

Further, *Research Disclosure* 24241, *ibid.* 11449 and JP-A-61-201247 disclose that bleach accelerating compound-releasing couplers contribute to the improvement of bleaching performance.

These methods certainly have the effect of improving the bleaching of the emulsions comprising tabular silver iodobromide grains. However, it is not considered that the above-described problem can be fully solved by such methods, and these methods are particularly ineffective in reducing the concentrations of the bleaching agents.

Specifically, the present inventors have found that even when the foregoing methods are carried out, the reduction in the concentrations of the iron(III) complex salts of the aminopolycarboxylic acids causes a lowering in the bleaching performance, and failure in the restoration of cyan dye.

SUMMARY OF THE INVENTION

Accordingly, an object of the present invention is to provide a novel processing method capable of rapidly bleaching silver halide color photographic materials obtained by coating emulsions comprising tabular silver iodobromide grains.

Another object of the present invention is to provide a processing method capable of processing the aforesaid photographic materials with excellent bleaching performance and restoring performance, even when there is a reduction in the concentrations of the iron(III) complex salts of organic acids to be used particularly as bleaching agents.

Still another object of the present invention is to provide a novel processing method which can reduce the amounts of the iron(III) complex salts of organic acids which are discharged, and allows processing to be carried out without causing serious environmental pollution.

The above-described objects of the present invention have been achieved by providing the following methods:

Method (1)

A method for processing a silver halide color photographic material comprising a support having thereon at least one silver halide emulsion layer which comprises subjecting the silver halide color photographic material to imagewise exposure and color development, and then processing the material with a processing solution having a bleaching ability, characterized in that (a) said silver halide emulsion layer contains silver halide grains having a composition in which tabular silver iodobromide grains having an aspect ratio of not lower than 3 account for at least 50% of the entire projected area of said silver halide grains, and (b) said processing solution having a bleaching ability contains an iron(III) complex salt of a compound represented by the following general formula (I) or (II) as a bleaching agent at a concentration of 0.01 to 0.17 mol/liter:

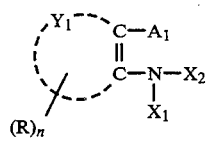

(I)

wherein $Y_1$ represents a non-metallic atomic group required for forming an arylene group or a bivalent heterocyclic group; R represents a substituent group; n represents 0 or an integer of 1 to 4, provided that, when n is 2 to 4, two or more R groups may be the same or different; $X_1$ represents hydrogen atom or $—L_1—A_2$; $X_2$ represents $—L_2—A_3$ or a group of the following formula

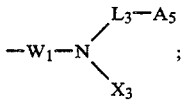

$X_3$ represents hydrogen atom, a hydroxyalkyl group or $—L_4—A_4$; $A_1$ and $A_5$ each represents a hydrogen atom, a carboxyl group, a sulfo group, a carbamoyl group, an acylamino group, an alkylsulfonamido group, a sulfamoyl group, a hydroxyalkyl group, an alkoxy group, an alkylthio group, $—Z—L_5—COOH$ or a group of the following formula:

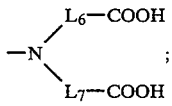

Z represents an oxygen atom or sulfur atom; $A_2$ represents a carboxyl group, a sulfo group, an alkylsulfonamido group or a phosphono group; $A_3$ and $A_4$ each represents a carboxyl group, a sulfo group or an alkylsulfonamido group; $L_2$, $L_4$, $L_5$, $L_6$ and $L_7$ each represents an alkylene group; $L_1$ and $L_3$ each represents an alkylene group or an arylene group; and $W_1$ represents a bivalent bonding group; or

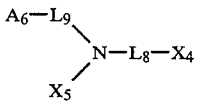

(II)

wherein $X_4$ represents a carboxyl group, an alkylsulfonamido group, $—S—L_{10}—A_7$ or a group of the following formula:

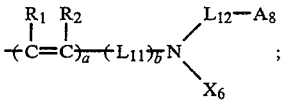

$X_5$ and $X_6$ each represents a hydrogen atom or $—L_{1-3}—COOH$; $A_7$ represents a hydrogen atom or a carboxyl group; $A_6$ and $A_8$ each represents a heterocyclic group, a carboxyl group, a carbamoyl group, an acylamino group, a hydroxamic acid group or $—S—L_{1-4}—COOH$, or $A_6$ and $A_8$ may be combined together to form a ring; a and b each represents 0 or 1; $R_1$ and $R_2$ each represents a hydrogen atom or an aliphatic group, or $R_1$ and $R_2$ together form a non-metallic atomic group required for forming an aryl group or a heterocyclic group; $L_8$, $L_9$, $L_{10}$, $L_{11}$, $L_{12}$, $L_{13}$ and $L_{14}$ each represents an alkylene group; and when a=b=0, there is no case where both $A_6$ and $A_8$ are simultaneously carboxyl groups, and when $X_4$ is carboxyl group, $A_6$ is a group other than carboxyl group.

Method (2)

A processing method as described in Method (1) above, wherein said processing solution having bleaching ability contains ammonium ion at a concentration of not higher than 0.3 mol/l.

Method (3)

A processing method as described in Method (1) above, wherein the silver halide emulsion layer of said silver halide color photographic material contains a compound which releases a bleaching accelerator by the reaction thereof with the oxidants of aromatic primary amine color developing agents.

DETAILED DESCRIPTION OF THE INVENTION

Now, the present invention will be illustrated in more detail below.

Tabular silver halide grains having an aspect ratio of not lower than 3, preferably lower than 8 account for at least 50%, preferably 80% or more, of the entire projected area of silver halide grains contained in at least one emulsion layer of the silver halide photographic material of the present invention.

In the present invention, tabular grains having an aspect ratio of not lower than 3 account for preferably at least 50%, particularly preferably at least 80% of the entire projected area of silver halide grains contained in the whole layers of the silver photographic material.

The term "tabular silver iodobromide grains", as used herein, refers to all of silver iodobromide grains having one or more twinning planes. The term "twinning plane" refers to the (111) face when all lattice points are ionic mirror images on both sides of the (111) face. The tabular silver iodobromide grains have a triangular form, a hexagonal form, or a roundish circular form when observed from above. The triangular-form grains have triangular outer surfaces parallel to each other, the hexagonal-form grains have hexagonal outer surfaces parallel to each other, and the circular-form grains have circular outer surfaces paralled to each other.

These tabular silver iodobromide grains may be grains having at least two laminar structures having substantially different halogen compositions within the silver halide grain, or they may be grains having a uniform halogen composition.

In an emulsion comprising the grains having laminar structures having different halogen compositions, the emulsion may comprise grains where the core of the grain is a high iodide content layer and the outermost layer is a low iodide content layer, or grains wherein the core is a low iodide content layer and the outermost layer is a high iodide content layer.

The aspect ratio of the tabular silver iodobromide grains in the present invention refers to a value obtained by dividing the diameter of the tabular silver iodobromide grain having a grain diameter of 0.1 μm or more by the thickness of the respective grain. The thickness of grain can be measured and calculated by depositing a metal together with reference latex on the grain from the oblique direction of the grain, measuring the length of shadow from an electron micrograph and referring to the length of the shadow of the latex.

The grain diameter (grain size) in the present invention refers to a diameter of a circle having an area equal to the projected area of the parallel outer surface of the grain. The projected area of the grain can be obtained by measuring the area on an electron micrograph and correcting photographing magnifications.

The tabular silver iodobromide grains have a grain diameter (grain size) of preferably 0.15 to 5 μm, particularly preferably 0.5 to 2.0 μm.

The thickness of the grain is preferably 0.05 to 1.0 μm.

Tabular silver iodobromide grains by which the effect of the present invention can be obtained are those having an aspect ratio of not lower than 3. The aspect ratio is preferably not lower than 5, but not higher than 30, in particular the aspect ratio is preferably not lower than 5, but not higher than 20 for the purpose of obtaining a more remarkable effect.

The tabular silver iodobromide grains of the present invention have a silver iodide content of preferably 1 to 30 mol %, and in particular, preferably 3 to 20 mol %.

Tabular grains which can be used in the present invention can be prepared by properly combining conventional methods.

Tabular silver halide emulsions are described in Cugnac and Chateau, *Evolution of Silver Bromide Crystals during Physical Ripening Science et Industrie Photography*, Vol. 33, No. 2 (1962), pp. 121–125; Duffin, *Photographic Emulsion Chemistry*, pp. 66–72 (Focal Press, New York 1966); and A. P. H. Trivelli, W. F. Smith, *Photographic Journal*, Vol. 80, page 285 (1940) and can be easily prepared by referring to the methods described in JP-A-58-127921, JP-A-58-113927 and JP-A-58-113928.

For example, the tabular grains can be obtained by forming seed crystals comprising at least 40% by weight of tabular grains in an atmosphere having a relatively high pAg value at a pBr of not more than 1.3 and growing seed crystals by adding a silver salt solution and a halide solution while the same pBr value or a higher pBr value is maintained.

It is desirable that the silver salt solution and the halide solution are added so that a new crystal nucleus is not formed during the course of the growth of grains by the addition of one or both of a water-soluble silver salt, such as, silver nitrate and a water-soluble halide.

Grain size, grain form (e.g., the ratio of diameter/thickness), grain size distribution and the growth rate of grains can be controlled by optionally using solvents for silver halide during the preparation of the tabular grains of the present invention. The amount of the solvent used is in the range of preferably $10^{-3}$ to 1.0% by weight, and, in particular is preferably $10^{-2}$ to $10^{-1}$% by weight, based on the amount of the reaction solution. The amount of the solvent used in the present invention is critical, because when there is an increase in the amount of solvent used the grain size distribution becomes monodisperse, and the growth rate of the grains can be expedited, while the thickness of the grain is apt to be increased.

Conventional solvents for silver halide can be used in the present invention. Examples of the solvents for silver halide which are often used include ammonia, thioethers and thioureas. Appropriate thioethers are described in U.S. Pat. Nos. 3,271,157, 3,574,628 and 3,790,387.

The growth rate of the tabular grains of the present invention can be adjusted by controlling temperature, the types and amounts of the solvents and their addition rate(s), and the amount(s) and concentration(s) of the silver salt solution (e.g., aqueous $AgNO_3$ solution), and the halide solution (e.g., aqueous KBr solution) used during the course of the preparation of the tabular grains . With regard to these methods , reference can be made to U.S. Pat. Nos. 1,335,925, 3,650,757, 3,672,900 and 4,242,445, JP-A-55-142329 and JP-A-55-158124.

The tabular grains of the present invention may be optionally chemical-sensitized.

Examples of chemical sensitization methods include a gold sensitization method using gold compounds (described, for example, in U.S. Pat. Nos. 2,448,060 and 3,320,069), a metal sensitization method using iridium, platinum, rhodium, palladium, etc. (described, for example, in U.S. Pat. Nos. 2,448,060, 2,566,245 and 2,566,263), a sulfur sensitization method using sulfur containing compounds (described, for example, in U.S. Pat. No. 2,222,264) and reduction sensitization method using tin salts, polyamines, etc. (described, for example, in U.S. Pat. Nos. 2,487,850, 2,518,698 and 2,521,925). These methods may be used either alone or in combinations of any two or more of such methods.

It is preferred that the silver halide emulsions of the present invention are subjected to reduction sensitization during or after the formation of the grains and before, during, or after chemical sensitization, excluding reduction sensitization.

The reduction sensitization can be properly chosen from among methods wherein:

a reduction sensitization agent is added to a silver halide emulsion;

silver halide grains are grown or ripened in a low pAg atmosphere at a pAg of 1 to 7, called silver ripening; and silver halide grains are grown or ripened in a high pH atmosphere at a pH of 8 to 11, called high pH ripening. These methods may be used either alone or in combination of two or more of them.

The method wherein a reduction sensitizing agent is added is a preferred method from the viewpoint that it allows the level of reduction sensitization to be finely controlled.

Examples of conventional reduction sensitizing agents include stannous salts, ascorbic acid and derivatives thereof, amines and polyamines, hydrazine derivatives, formamidinesulfinic acid, silane compounds and borane compounds. The reduction sensitization of the present invention can be carried out by properly choosing reduction sensitizing agents from among conventional compounds. Two or more compounds may be used in combination. Examples of the reduction sensitizing agents which can preferably be used in the present invention include stannous chloride, thiourea dioxide, dimethylaminoborane and ascorbic acid and its derivatives. The amount of the reduction reducing agent added in the present invention varies depending on the preparation conditions of the emulsions, but is generally in the range of preferably $10^{-7}$ to $10^{-3}$ mol per mol of silver halide.

The reduction sensitizing agents are dissolved in a solvent, such as, water, an alcohol, a glycol, a ketone, an ester or an amide, and are added during the course of the growth of the grains. The reduction sensitizing agents may be previously added to the reaction container, but it is preferred that the agents be added at a suitable stage during the course of the growth of the silver halide grains. The reduction sensitizing agents may be previously added to an aqueous solution of a water-soluble silver salt or a water-soluble alkali metal halide, and silver halide grains may be precipitated by using the resulting aqueous solution. It is also preferred that a solution of the reduction sensitizing agent is portionwise added as the silver halide grains are grown, or the solution is continuously added over a long period of time.

The silver halide emulsions of the present invention may be subjected to a treatment wherein grains are rounded, as disclosed in European Patents 96,727B1 and 64,412B1, or a treatment wherein the surfaces of grains are modified, as disclosed in West German Patent 2,306,447C2 and JP-A-60-221320.

Generally, the surfaces of the grains in the silver halide emulsions of the present invention have a flat structure. However, it is often preferred that the surfaces of the grains are intentionally made uneven. Examples of such grains having an uneven surface include grains wherein the crystal is partially perforated, for example, the apex or the central part of the crystal is perforated, as described in JP-A-58-106532 and JP-A-60-221320; and raffle grains as described in U.S. Pat. No. 4,643,966.

It is desirable that the tabular grains in the emulsions of the present invention have at least one dislocation. The dislocation can be chosen from among the following ones: one linearly introduced into the crystal in the specific direction of the crystal orientation of the grain; a curved one; one introduced into the whole of the grain; and one introduced into a specific part of the grain, for example, introduced one only into the flange of the grain.

It is well known that dislocation is displacement (shear) of a series of atom configurations in crystal lattice, and the general definition thereof is clearly described in *Introduction to Dislocation Theory*, pp. 24–31, written by Hideji Suzuki, published by Agune sha (1968).

The silver halide emulsions of the present invention may comprise core/shell type, or double structure type grains, wherein the interior of the grain and the surface layer thereof differ from each other in halogen composition, as described in JP-B-3-13162 (the term "JP-B" as used herein means an "examined Japanese patent publication"), JP-A-61-215540, JP-A-60-222845, JP-A-60-143331 and JP-A-61-75337, or, not double structure, but triple structure type grains, or multilayer structure type grains of more than triple structure, or grains having such a structure that a thin film of silver halide, having a different halogen composition from that of the host grain, is provided on the surface of the core/shell type double structure grain, as described in JP-A-60-222844.

Grains having an internal structure used as the silver halide grains of the present invention include such wrapping-in type grains, as mentioned above, and grains having a joined structure. Examples of the grains having a joined structure include those described in JP-A-59-133540, JP-A-58-108526, European Patent 199,290A2, JP-A-58-24772 and JP-A-59-16254. A crystal to be joined has a different halogen composition from that of a host crystal and is joined to the edge, corner, or plane of the host crystal. The host crystal of the crystal having such a joined structure, as mentioned above, may be any grains having a uniform halogen composition, and core/shell type grains.

In the case of such joined structures, silver halides can be joined to each other, and further, the joined structure may be formed by joining silver halide to a silver chloride compound having no rack salt structure, such as, silver rhodanide or silver carbonate. Furthermore, a non-silver salt compound such as lead oxide may be used to form such joined structures.

In the case of grains having these structures, such as, silver iodobromide grains, it is preferred that the silver iodide content of the core is higher than that of the shell. In some cases, however, it is preferred that the silver iodide content of the shell is higher than that of the core. Similarly, in the case of grains having a joined structure, the grains may have such a silver iodide content distribution that the silver iodide content of the host crystal is high and that of the joined crystal is relatively low or that the silver iodide content is reversed to that described above . The boundary between areas having different halogen compositions in the grains having these structures may be a definite one or an indefinite one. In certain cases, grains are preferred wherein the halogen composition is continuously changed.

When silver halide grains comprise a mixed crystal of two or more silver halides, or have a structure comprising two or more silver halides, it is important that the halogen composition distribution between grains is controlled. A method for measuring the halogen composition distribution between grains is described in JP-A-60-254032. It is a preferred characteristic that the halogen composition distribution between grains is uniform. Emulsions are preferred which have a high uniformity, wherein the coefficient of variation is not higher than 20%. In another embodiment, emulsions are preferred which have a correlation between grain size and halogen composition. For example, there are preferred grains having a correlation such that larger-size grains have a higher iodide content, and smaller-size grains have a lower iodide content. A reverse correlation to that described above and other halogen compositions can be chosen depending on the purpose. For this purpose, it is preferred that two or more emulsions having different compositions are mixed.

It is important that the halogen composition in the vicinity of the surfaces of the silver halide grains of the present invention is controlled. An increase in either the silver iodide content or the silver chloride content in the vicinity of the surfaces of the grains is chosen according to the purpose, because the adsorptivity of dyes and the development rate are changed. When the halogen composition in the vicinity of the surfaces of the grains is to be changed, any of the wrapping-in type structural grains, and the partial deposition type structural grains can be chosen. For example, the halogen compositions of the main planes, and one side of the tabular grain are changed.

Gelatin can be advantageously used as a protective colloid in the preparation of the silver halide emulsions of the present invention, and as a binder for other hydrophilic colloid layers. However, other hydrophilic colloids can also be used.

Examples of useful hydrophilic colloids include proteins, such as, gelatin derivatives, graft polymers of gelatin with other high-molecular materials, albumin and casein; cellulose derivatives, such as, hydroxyethyl cellulose, carboxymethyl cellulose, and cellulose sulfate; sugar derivatives, such as, sodium alginate and starch derivatives; and synthetic hydrophilic high-molecular materials, such as, homopolymers and copolymers, for example, polyvinyl alcohol, polyvinyl alcohol partial acetal, poly-N-vinylpyrrolidone, polyacrylic acid, polymethacrylic acid, polyacrylamide, polyvinyl imidazole, and polyvinyl pyrazole.

Examples of gelatins which can be used in the present invention include lime-processed gelatins, acid-processed gelatins, and enzyme-processed gelatins, as described in *Bull. Soc. Sci. Photo. Japan* No. 16, 930 (1966). Further, hydrolyzates and enzymatic hydrolyzates of gelatin can be used.

In the present invention, it is particularly preferred that low-molecular gelatins having molecular weight of not more than 70,000 be used during nucleation.

It is preferred that the silver halide emulsions of the present invention are washed with water to carry out desalting, and are then dispersed in a fresh protective colloid. The temperature of water washing may very widely depending on the purpose, but is preferably in the range of 5° to 50° C. The pH during water washing may very widely depending on the purpose, but is generally in a preferred range of 2 to 10, and more preferably 3 to 8. The pAg during rinsing varies depending on the purpose, but is preferably in the range of 5 to 10. Examples of water washing methods include noodle washing, dialysis methods using a semi-membrane, centrifugal separation, coagulation methods, and ion exchange methods. Examples of coagulation methods include methods using a sulfate, methods using an organic solvent, methods using a water-soluble polymer, and method using gelatin derivatives.

The thickness of the layer containing the tabular grains is preferably 0.3 to 5.0 μ, and more particularly is preferably 0.5 to 4.0 μ.

The coating weight (per one side) of the tabular grains is preferably 0.5 to 6 g/m$^2$, and more particularly is preferably 1 to 4 g/m$^2$.

The emulsion layers of the silver halide photographic materials of the present invention may contain the usual silver halide grains, e.g., spherical grains, in addition to tabular grains . The silver halide grains can be prepared by using the methods described in P. Glafkides, *Chimie et Physique Photographique* (Paul Montel 1967), G. F. Duffin, *Photographic Emulsion Chemistry*. (The Focal Press 1966) and V. L. Zelikmen et al., *Making and Coating Photographic Emulsion* (The Focal Press 1964).

Cadmium salt, zinc salt, lead salt, thallium salt, iridium salt, or complex salts thereof, rhodium salt or complex salts thereof, or iron salt, or complex salts thereof, may be allowed to coexist during the course of the formation of the silver halide grains, or during the physical ripening thereof. If desired, the silver halide grains may be chemical-sensitized, as in the case of the tabular grains.

The photographic emulsions, e.g., emulsions containing tabular grains, of the present invention may contain various compounds to prevent fogging during the preparation, storage or photographic processing of the photographic materials, or to stabilize photographic performance. Examples of compounds known as antifogging agents or stabilizers include azoles such as benzthiazolium salts, nitroindazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles, mercaptotetrazoles (particularly 1-phenyl-5-mercaptotetrazole); mercaptopyrimidines, mercaptotriazines; thioketo compounds such as oxazolinethione; azaindenes such as triazaindenes, tetrazaindenes (particularly 4-hydroxy substituted (1,3,3a,7)tetrazaindenes), pentazaindenes; and benzenethiosulfonic acid, benzenesulfonic acid, and benzenesulfonic acid amide. For example, compounds described in U.S. Pat. Nos. 3,954,474 and 3,982,947, and JP-B-52-28660 can be used.

The tabular grains of the present invention are spectral-sensitized with sensitizing dyes.

Usually, methine dyes are used as spectral-sensitizing dyes in the present invention. The methine dyes which can be used in the present invention include cyanine dyes, merocyanine dyes, complex cyanine dyes, complex merocyanine dyes, holopolar cyanine dyes, hemicyanine dyes, styryl dyes and hemioxonol dyes. The details of these dyes are described in JP-A-2-46448 (the 4th line from the bottom of left upper column of page 5 to right lower column of page 7; particularly useful sensitizing dyes are the cyanine dyes of general formula (I), as described in left lower column of page 5). Specific examples of the sensitizing dyes include compounds I-1 to I-26 described in the aforesaid JP-A-2-46448 (pages 6 to 7).

These sensitizing dyes may be used either alone or in combination. The combinations of the sensitizing dyes are often used for the purpose of supersensitization.

In addition to the sensitizing dyes, the emulsions may contain a dye which itself does not have a spectral sensitization effect or a substance which does not substantially absorb visible light, but has a supersensitization effect. For example, the emulsions may contain nitrogen-containing heterocyclic group-substituted aminostilbene compounds , e.g., those described in U.S. Pat. Nos. 2,933,390 and 3,635,721, aromatic organic acid formaldehyde condensates, e.g., those described in U.S. Pat. No. 3,743,510, cadmium salts and azaindene compounds. Combinations described in U.S. Pat. Nos. 3,615,613, 3,615,641, 3,617,295 and 3,635,721 are particularly useful.

The sensitizing dyes are preferably used in an amount of 100 to 1,000 mg, and more particularly, preferably in an amount of 200 to 600 mg per mol of the tabular grain.

The sensitizing dyes of the present invention are dissolved in water or a water-miscible organic solvent, such as, methanol, ethanol, propyl alcohol, methyl cellosolve, or pyridine, and the resulting aqueous solution or organic solvent solution is added to the silver halide emulsions.

The iron(III) complex salts of the present invention will be illustrated below.

In the above-described general formulas, $Y_1$ represents a non-metallic atomic group required for forming an arylene group or a bivalent heterocyclic group. The arylene group formed by $Y_1$ may be a monocyclic group or a fused ring with an aromatic ring or a heterocyclic ring. However, a monocyclic group or a bicyclic group is preferred. Examples of the arylene group formed by $Y_1$ include a phenylene group and a naphthylene group. The bivalent heterocyclic group formed by $Y_1$ is a three-membered to ten-membered saturated or unsaturated bivalent heterocyclic group having at least one nitrogen, oxygen or sulfur heteroatom which may be a monocyclic ring or a fused ring with an aromatic ring or a heterocyclic ring. However, the bivalent heterocyclic group formed by $Y_1$ is preferably a five-membered to six-membered heterocyclic group. Examples of the bivalent heterocyclic group include bivalent groups where a bivalent moiety is formed by neighboring carbon atoms, derived from a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring and an oxazole ring. Preferred examples thereof include bivalent groups where a bivalent moiety is formed by neighboring carbon atoms, derived from a pyrrole ring, an imidazole ring, a pyridine ring, a triazole ring, a thiadiazole ring, an oxadiazole ring, a quinoxaline ring, a tetrazole ring, a thiazole ring and an oxazole ring. A particular preference is that $Y_1$ is a phenylene group.

Examples of the substituent group represented by R include an alkyl group, an aralkyl group, an alkenyl group, an alkynyl group, an alkoxy group, an aryl group, an amino group, an acylamino group, a sulfonamido group, a ureido group, a urethane group, an aryloxy group, a sulfamoyl group, a carbamoyl group, an alkylthio group, an arylthio group, a sulfonyl group, a sulfinyl group, an acyl group, a hydroxy group, a halogen atom, a cyano group, a sulfo group, a carboxyl group, a phosphono group, an aryloxycarbonyl group, an alkoxycarbonyl group, an acyloxy group, nitro group, a hydroxamic acid group, and a heterocyclic group. When these substituent groups have a carbon atom-containing chain, the sum total of carbon atoms is preferably 1 to 10, and more preferably is 1 to 4.

Preferably, $X_1$ is $—L_1—A_2$, and $X_3$ is $—L_4—A_4$. Preferably, $X_4$ is carboxyl group, or a group of the following formula

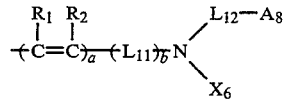

A particular preference is that $X_4$ is the group of the above formula. Preferably, $X_5$ and $X_6$ each is $—L_{1-3}—COOH$.

The alkylene group represented by $L_1$ to $L_{14}$ may be a straight-chain, branched, or cyclic group, and may be optionally substituted by one or more of the substituent groups as already described above in the definition of R (preferably a carboxyl group, a hydroxy group, or a halogen). The alkylene group has preferably 1 to 10 carbon atoms. More preferably, $L_1$ to $L_7$ and $L_9$ to $L_{14}$ each is a methylene group or an ethylene group, and $L_8$ has 2 to 5 carbon atoms.

The arylene group represented by $L_1$ and $L_3$ may be a monocyclic group or a fused ring with an aromatic ring or a heterocyclic ring, and may be optionally substituted by one or more substituent groups as already described above in the definition of R (preferably, an alkyl group, an acylamino group, an alkylsulfonamido group, an alkoxy group, a sulfamoyl group, a carbamoyl group, an alkylthio group, a sulfo group, a phosphono group, an acyl group, an alkoxycarbonyl group, a nitro group, a carboxyl group, a hydroxy group, a halogen and a hydroxamic acid group). Examples of the arylene groups represented by $L_1$ and $L_3$ include a phenylene group, and a naphthylene group. More preferably, the arylene group is a group represented by the following general formula:

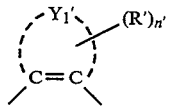

wherein $Y_1'$, R' and n' each has the same meaning as $Y_1$, R and n, respectively.

Preferably, $L_1$ and $L_3$ each is an alkylene group.

The alkyl portion of the hydroxyalkyl group represented by $X_3$, $A_1$ and $A_3$ may be straight-chain, branched, or cyclic, and may be optionally substituted by one or more substituent groups (preferably, a carboxyl group, a hydroxy group, or a halogen). The alkyl portion has preferably 1 to 10 carbon atoms, and more preferably has 1 to 3 carbon atoms. Examples of the hydroxyalkyl group include hydroxymethyl and hydroxyethyl groups.

The carbamoyl groups represented by $A_1$, $A_5$, $A_6$ and $A_8$ and the sulfamoyl group represented by $A_1$ and $A_5$ may be substituted by one or more substituent groups (preferably, an alkyl group, an aryl group, a heterocyclic group) and have preferably not more than 10 carbon atoms, and, more preferably, not more than 4 carbon atoms. Examples of the carbamoyl groups include carbamoyl, N-methylcarbamoyl, N,N-dimethylcarbamoyl and N-(4-sulfophenyl)carbamoyl. Examples of the sulfamoyl groups include sulfamoyl and N-methylsulfamoyl.

The alkylsulfonamido groups represented by $A_1$, $A_2$, $A_3$, $A_4$ and $A_5$ may be substituted by one or more substituent groups (preferably, a carboxyl group, a hydroxy group, and a halogen), and has preferably 1 to 5 carbon atoms, and, more preferably, 1 to 3 carbon atoms. Examples of the alkylsulfonamido groups include methanesulfonamido and trifluoromethanesulfonamido groups.

The acylamino groups represented by $A_1$, $A_5$, $A_6$ and $A_7$ may be substituted by one or more substituent groups (preferably, an alkyl group, an aryl group, a heterocyclic group, a halogen, a carboxyl group, and a hydroxy group), and is preferably an alkylacylamino group having 1 to 10 carbon atoms, an arylacylamino group having 6 to 10 carbon atoms, or a heterocyclic acylamino group having 1 to 10 carbon atoms. An alkylacylamino group having 1 to 5 carbon atoms is more preferred. Specific examples of the acylamino groups include acetylamino, benzoylamino, t-butaneamido, and trifluoroacetylamino groups.

The alkoxy group and the alkylthio group represented by $A_1$ and $A_5$ have preferably 1 to 10 carbon atoms, and, more preferably, 1 to 5 carbon atoms, and include methoxy, ethoxy and methylthio groups.

The heterocyclic group represented by $A_6$ and $A_8$ is a three-membered to ten-membered saturated or unsaturated bivalent heterocyclic group having at least one nitrogen, oxygen, or sulfur hetero-atom which may be a monocyclic group or a fused ring with an aromatic ring or a heterocyclic ring. Preferably, the heterocyclic group is a five-membered or six-membered unsaturated heterocyclic group. Examples of the heterocyclic groups include a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring, and an oxazole ring. Among them, preferred are a pyrrole ring, an imidazole ring, a pyridine ring, a triazole ring, a thiadiazole ring, an oxadiazole ring, a quinoxaline ring, a tetrazole ring, a thiazole ring, and an oxazole ring.

Preferably, $A_1$ is a carboxyl group or —Z—L-$_5$—COOH, with a carboxyl group being particularly preferred. Preferably, $A_2$, $A_3$, $A_4$ and $A_5$ each is a carboxyl group or a sulfo group, with a carboxyl group being particularly preferred. Preferably, $A_6$ and $A_8$ each is a carbamoyl group, a carboxyl group, or a heterocyclic group, with a carboxyl group being particularly preferred. Preferably, $A_7$ is a carboxyl group.

Preferably, $W_1$ is an alkylene group, an alkenylene group, an arylene group, a bivalent heterocyclic group, or a bivalent bonding group composed of a combination of two or more of these groups. More preferably, $W_1$ is a group represented by the following general formula (W):

$$-W_2\text{-}(X-W_3)_c\text{-}(W_4)_d\text{-}(W_5)_e \qquad \text{(W)}$$

wherein $W_2$, $W_3$ and $W_5$ each represents an alkylene group; $W_4$ represents a group of the following formula

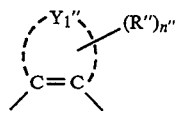

wherein Y'', R'' and n'' each has the same meaning as Y, R and n in general formula (I); c represents an integer of 0 to 3; d and e each represents 0 or 1; X represents —O—, —S— or —N($R_3$)—; and $R_3$ represents a hydrogen atom, an alkyl group (e.g., methyl, carboxymethyl, hydroxymethyl) or an aryl group (e.g., phenyl, 4-sulfophenyl).

$W_1$ is preferably a group where c is 0, and, more preferably is a group where d and e each is 0.

$W_1$ has preferably 1 to 20 carbon atoms, and more preferably, 2 to 10 carbon atoms; a particular preference is 2 to 5 carbon atoms.

Examples of $W_1$ include the following groups:

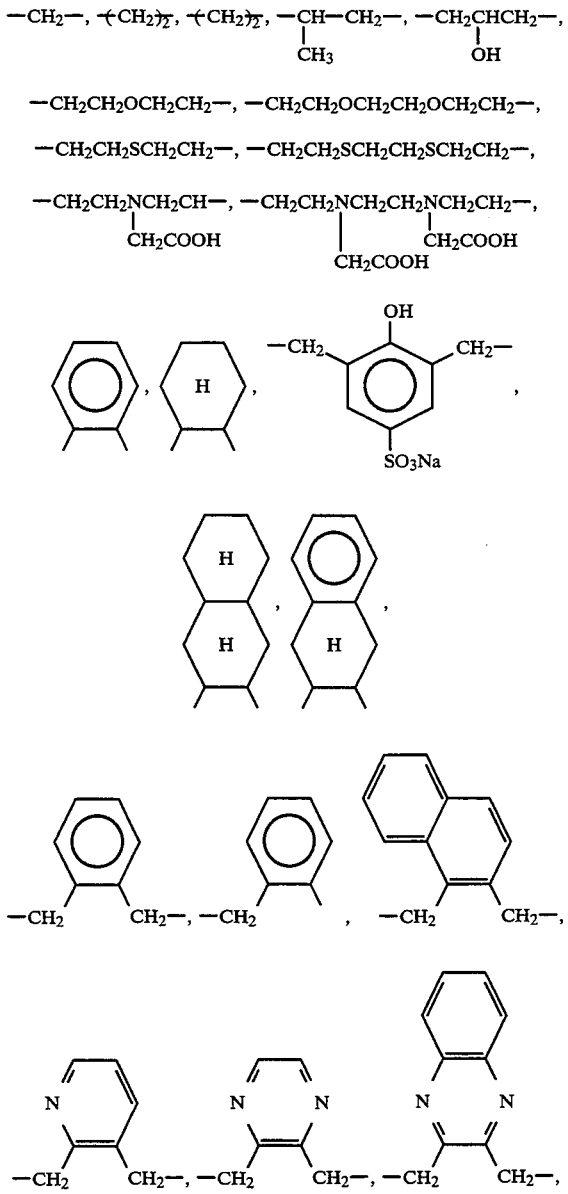

-continued

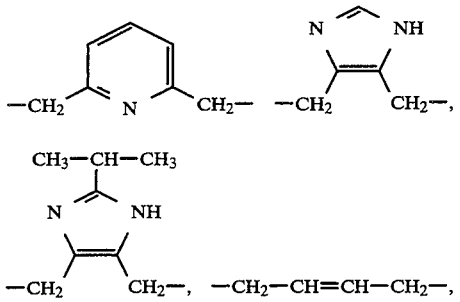

$R_1$ and $R_3$ each represents a hydrogen atom, an aliphatic group, or together form a non-metallic atomic group required for forming an aryl group or a heterocyclic group. The aliphatic group is a straight-chain, branched, or cyclic alkyl or alkenyl group which may be optionally substituted by one or more substituent groups as already described above in the definition of R. The heterocyclic group formed by combining $R_1$ and $R_2$ together includes the bivalent heterocyclic group represented by $Y_1$. Preferably, $R_1$ and $R_2$ together form an aryl group.

The compounds of general formula (I) are preferably compounds represented by the following general formulas (I-a) and (I-b):

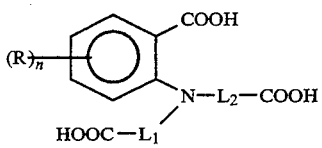

(I-a)

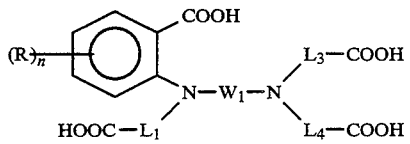

(I-b)

wherein $L_1$, $L_2$, $L_3$, $L_4$, $W_1$, R and n are as defined in general formula (I).

The compounds of general formula (II) are preferably compounds represented by the following general formulas (II-a), (II-b) and (II-c):

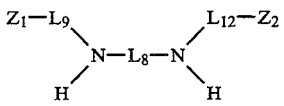

(II-a)

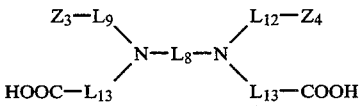

(II-b)

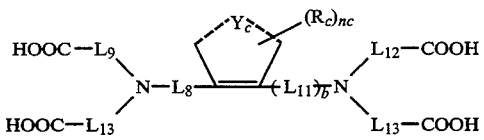

(II-c)

wherein $Z_1$ and $Z_2$ each represents a heterocyclic group; $Z_3$ and $Z_4$ each represents a carbamoyl group; $Y_c$, $R_c$ and $n_c$ each has the same meaning as Y, R and n in general formula (I); and $L_8$, $L_9$, $L_{11}$, $L_{12}$, $L_{13}$ and b are as defined in general formula (II).

Examples of the compounds of general formulas (I) and (II) include, but are not limited to, the following compounds:

1. 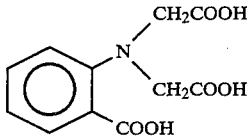

2. 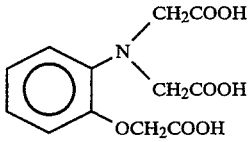

3. 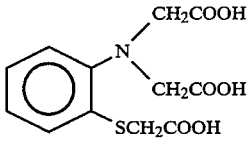

4. 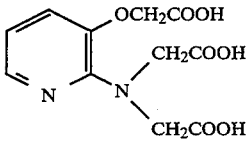

5. 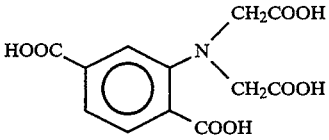

6. 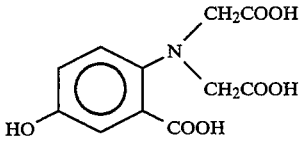

7. 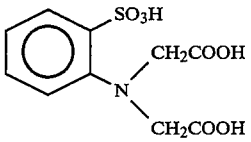

8. 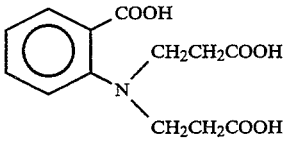

9. 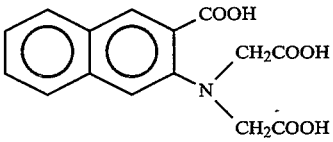

10. 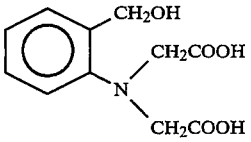

-continued
11.
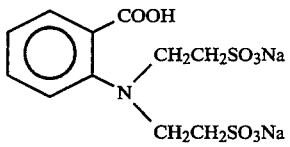
12.
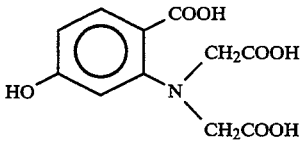
13.
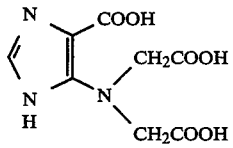
14.
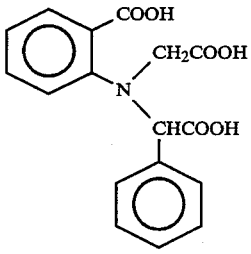
15.
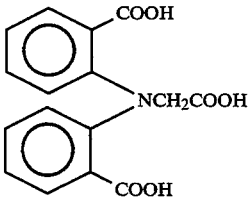
16.
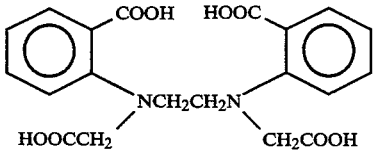
17.
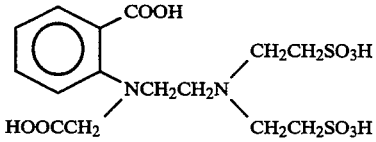
18.
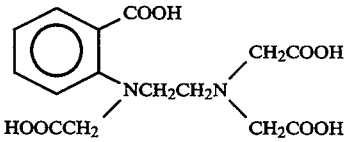
19.
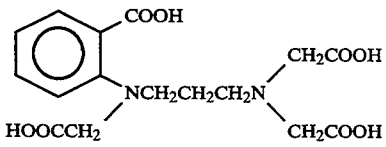
-continued
20.
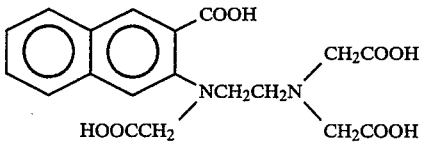
21.
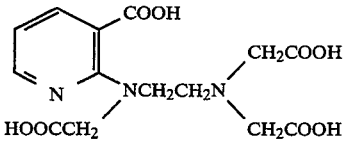
22.
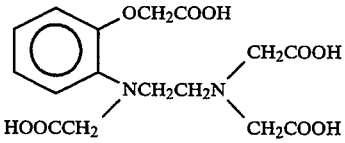
23.
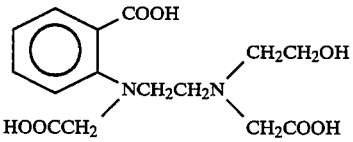
24.
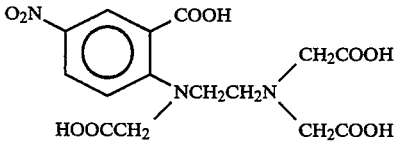
25.
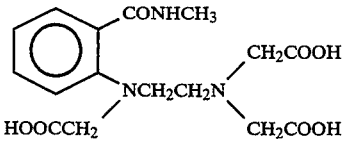
26.
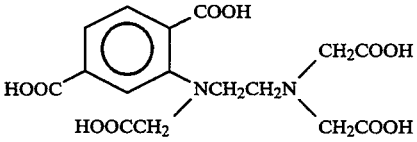
27.
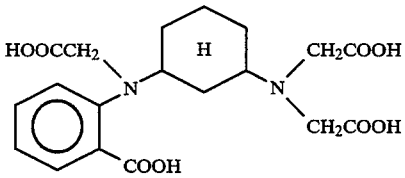
28.
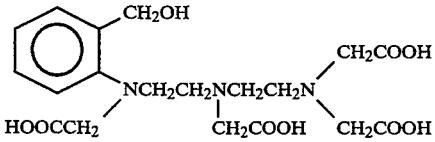
29.
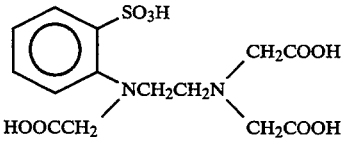

-continued
30.
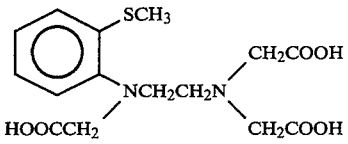
31.
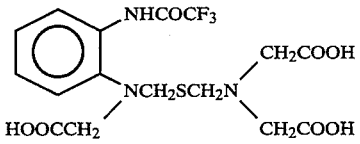
32.
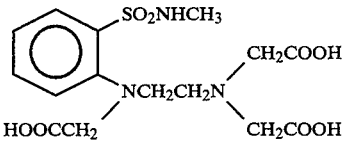
33.
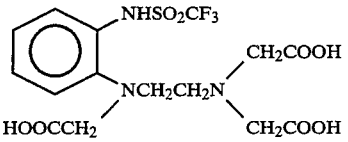
34.
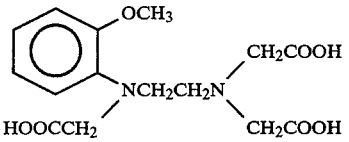
35.
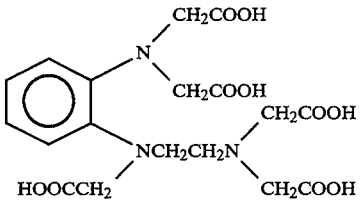
36.
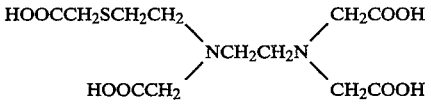
37.
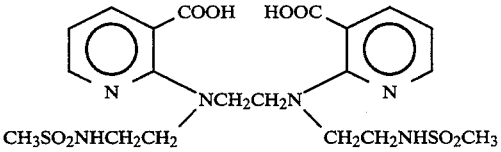
38.
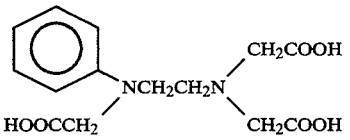
39.
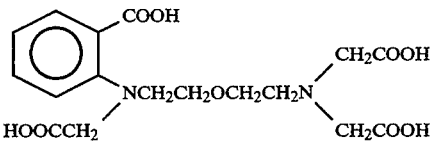
-continued
40.
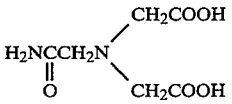
41.
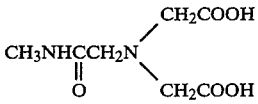
42.
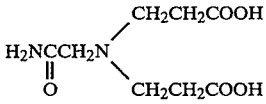
43.
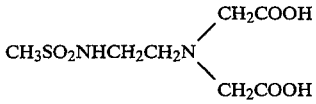
44.
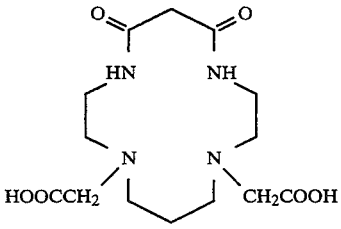
45.
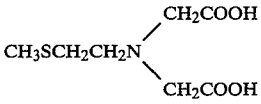
46.
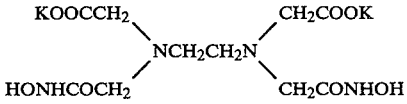
47.
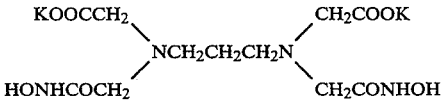
48.
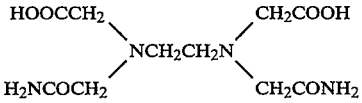
49.
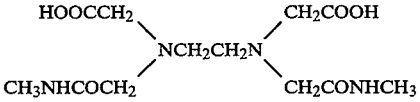
50.
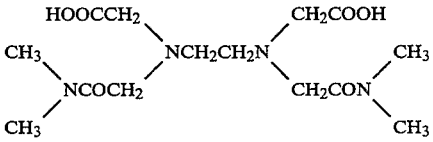
51.
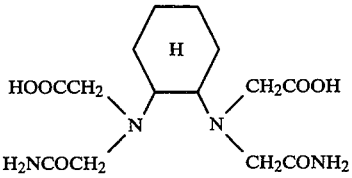

-continued

52.

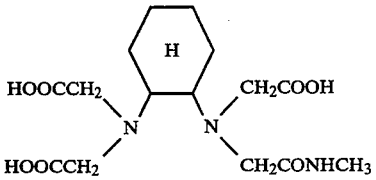

53.

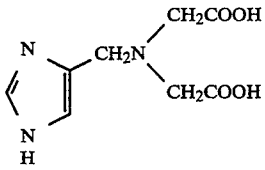

54.

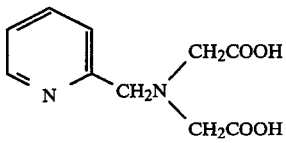

55.

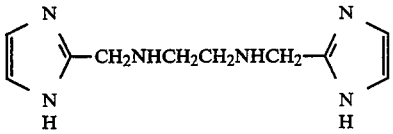

56.

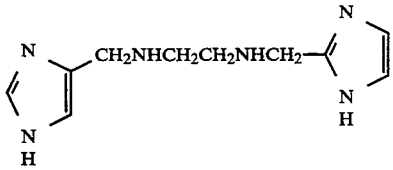

57.

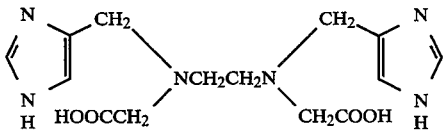

58.

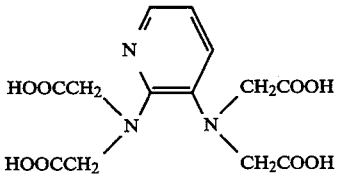

59.

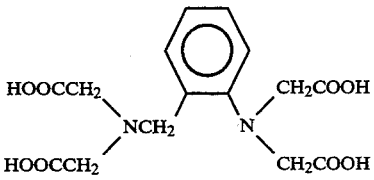

60.

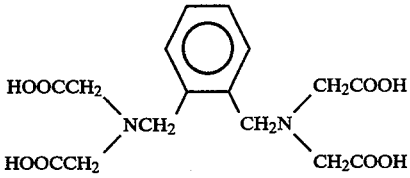

-continued

61.

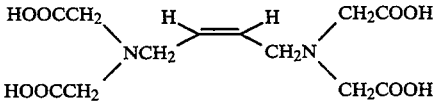

62.

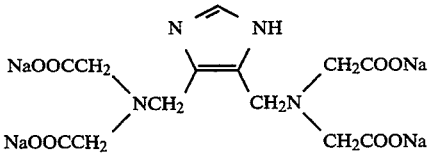

63.

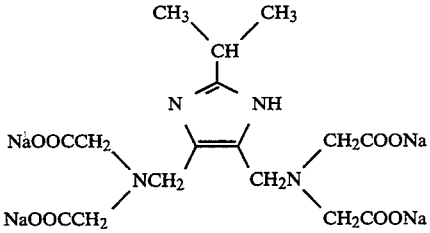

64.

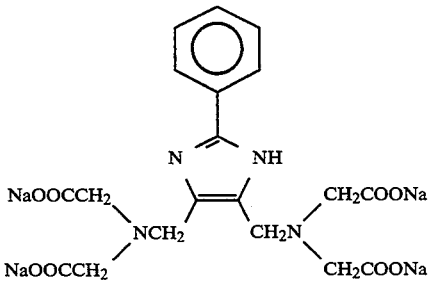

65.

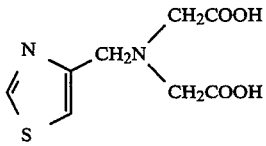

66.

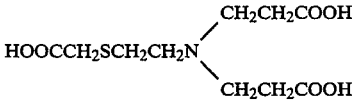

The iron(III) complex salts of the present invention can be easily obtained by dissolving a compound of general formula (I) or (II) and a water-soluble iron(III) salt, such as, ferric nitrate, ferric chloride, ferric bromide, or ferric sulfate in water and reacting them while maintaining the pH in the range of 2 to 9 by adding an alkaline compound, such as, sodium hydroxide, potassium hydroxide or ammonium hydroxide. It is preferred that ferric chloride, ferric nitrate or ferric bromide is used as the ferric salt.

In this reaction, the compounds of general formula (I) or (II) are used in an amount of preferably 1.0 to 2.5 mol; a particular preference is to use 1.0 to 1.1 mol per mol of the ferric salt.

The iron(III) complex salts of the organic acids according to the present invention may be previously prepared, and processing solutions having bleaching ability may be prepared by using the iron(III) complex salts previously prepared, as mentioned hereinbefore.

The term "processing solution having bleaching ability" as used herein refers to a solution containing an iron(III) complex salt formed from a compound of general formula (I) or (II), and a ferric ion, as a bleaching agent, and includes both bleaching solutions and bleaching-fixing solutions.

In the processing solutions having bleaching ability according to the present invention, the processing solutions containing the iron(III) complex salts of the compounds of general formula (I) are preferred from the viewpoint of providing more rapid bleaching and restoration of color.

The iron(III) complex salts of the compounds of general formulas (I-a) and (I-b) are more preferred because, even when they are reduced to ferrous salts, the oxidation rate by air is high, and they are very easily converted into the ferric complex salts, and hence they can be used at lower concentrations.

Bleaching solutions containing the iron(III) complex salts of the present invention will be illustrated below.

Even when the iron(III) complex salts of the present invention in an amount of 0.2 to 1.0 mol/l are contained in the bleaching solutions, as in the case of conventional bleaching agents, the iron(III) complex salts of the present invention have an excellent effect on tabular silver iodobromide grains, while when conventional bleaching agents, such as, (ethylenediaminetetraacetato)iron(III) complex salt, and (1,3-diaminopropanetetraacetato)iron(III) complex salt, are used at a low concentration, the bleaching ability of tabular silver iodobromide grains is greatly reduced. However, the iron(III) complex salts of the present invention have high bleaching ability and high ability to restore color, even when used at a low concentrations, and we have found that they can be used at lower concentrations in comparison with conventional bleaching agents.

It is preferred, from the viewpoint of the preservation of the environment, that the iron(III) complex salts of the present invention are used at a low concentrations in the range of 0.05 to 0.16 mol/l, and further it is preferred, from the viewpoint of conducting more rapid processing, that the iron(III) complex salts of the present invention are used at concentration in the range of 0.08 to 0.15 mol/l.

The iron(III) complex salts of the present invention can be used in combinations of two or more of them to utilize more effectively the advantage of each of them according to the intended purpose. For example, a combination of the iron(III) complex salts of the compounds of general formulas (I-a) and (I-b), a combination of the iron(III) complex salts of the compounds of general formulas (I-a) and (II-c), and a combination of the iron(III) complex salts of the compounds of general formulas (I-b) and (II-c) can be used.

The bleaching solutions of the present invention may contain conventional bleaching agents, such as, the iron(III) complex salts of ethylenediaminetetraacetic acid, diethylenetriaminepentaacetic acid, 1,3-diaminopropanetetraacetic acid, nitrilotriacetic acid, β-alaninediacetic acid, and cyclohexanediaminetetraacetic acid, in addition to the iron(III) complex salts of the present invention.

When the iron(III) complex salts of the present invention are used in combination with conventional bleaching agents, the iron(III) complex salt of the present invention accounts for preferably at least 50 mol %, more preferably at least 80 mol % of the total amount of all bleaching agents.

Such a combination of the bleaching agents as mentioned above has a synergistic effect on individual bleaching solutions, depending on conditions. For example, a combination of the iron(III) complex salts of the present invention with (ethylenediaminetetraacetato) iron(III) complex salt gives a very high bleaching rate, and a combination of the iron(III) complex salts of the present invention with (1,3-diaminopropanetetraacetato)iron(III) complex salt has a very high ability to restore color.

Bleaching agents which are particularly suitable for use in combination with the iron(III) complex salts of the present invention include (ethylenediaminetetraacetato)iron(III) complex salt, and (1,3-diaminopropanetetraacetato)iron(III) complex salt.

While the bleaching solutions of the present invention are used at a pH of 2 to 8, it is preferably used at a pH of 3 to 6.5 and more preferably 4 to 5.5 so as to attain excellent bleaching performance and restoring performance.

When processing is conducted with the bleaching solutions of the present invention, the processing temperature and time is preferably 30° to 50° C. for 20 seconds to 4 minutes; a particular preference is for processing at 35° to 45° C., for 30 seconds to 3 minutes.

It is preferred that the bleaching solutions of the present invention contain

- bromides, such as, ammonium bromide, potassium bromide and sodium bromide, as rehalogenating agents for accelerating the bleaching reaction;
- bleaching accelerators, as described in JP-A-3-213853 (the 19th line of left lower column of page 5 to the 13th line of right lower column of page 5); and
- stainless corrosion inhibitors, such as, ammonium nitrate and potassium nitrate.

Further, it is preferred that organic solvents be added as pH buffering agents to maintain the pH value in a preferred range. Organic acids, as described in JP-A-3-213853 (the 7th line of right upper column to the 5th line of left lower column of page 5), are preferred; acetic acid, glycolic acid, lactic acid, and citric acid are particularly preferred.

The bleaching agents of the present invention may contain the compounds of general formulas (I) or (II) which are not complexed with the iron salt, and aminopolycarboxylic acids, such as, ethylenediaminetetraacetic acid.

The bleaching-fixing solutions of the present invention will be illustrated below.

Even when the iron(III) complex salts of the present invention are contained in the bleaching-fixing solutions in an amount of 0.2 to 1.0 mol/l, as in the case of conventional bleaching agents, the iron(III) complex salts of the present invention have good effects on tabular silver iodobromide grains. However, it is preferred, from the viewpoint of the preservation of the environment, that the iron(III) complex salts of the present invention are used at low concentrations in the range of 0.05 to 0.16 mol/l.

Further, it is most preferred, from the viewpoint of conducting more rapid bleaching, that the iron(III) complex salts of the present invention are used at concentrations in the range of 0.10 to 0.15 mol/l.

The iron(III) complex salts of the compounds of general formula (I-b) are particularly preferred from the viewpoint of reducing the difficultly of causing the oxidative destruction of fixing agents coexisting in the bleaching-fixing solutions.

The bleaching-fixing solutions may contain two or more members of the iron(III) complex salts of the present invention in combination.

The bleaching-fixing solutions may contain conventional bleaching agents such as the iron(III) complex salts of ethylenediaminetetraacetic acid, diethylenetriaminepentaacetic acid, β-alaninediacetic acid and cyclohexanediaminetetraacetic acid.

When the iron(III) complex salts of the present invention are used in combination with conventional bleaching agents, the iron(III) complex salt of the present invention preferably accounts for at least 50 mol %, and, more particularly, preferably accounts for at least 80 mol % of the total amount of the entire bleaching agents.

Such a combination of the iron (III ) complex salts of the present invention with conventional bleaching agents has a synergistic effect on individual bleaching agents, depending on conditions. For example, a combination of the iron(III) complex salts of the compounds of general formula (I-b) with (ethylenediaminetetraacetato)iron(III) complex salt gives a bleaching rate which can not be attained by the use of the individual bleaching agents alone.

The bleaching-fixing solutions of the present invention may contain conventional fixing agents. Preferred examples of the fixing agents include thiosulfates, such as, ammonium thiosulfate, sodium thiosulfate and potassium thiosulfate; thiocyanates such as ammonium thiocyanate and sodium thiocyanate; thioether compounds, such as, 3,6-dithiaoctane-1,8-diol; thioureas; and isoionic compounds, as described in U.S. Pat. No. 4,378,424. Among them, thiosulfates are particularly preferred.

Sulfites, such as, sodium sulfite and ammonium sulfite, bisulfites, such as, sodium bisulfite, carbonyl bisulfite adducts, and sulfinates, as described in EP 294,769A are preferred as preservatives for thiosulfates in bleaching-fixing solutions. However, sulfinates, such as, typically sodium p-toluenesulfinate, and sodium benzenesulfinate, are preferred in the bleaching-fixing solutions of the present invention.

The processing temperature and time is preferably 30° to 50° C. for 30 seconds to 5 minutes; a particular preference is for processing at 35° to 45° C. for 1 to 3 minutes.

The bleaching-fixing solutions of the present invention have a pH of preferably 3 to 8, and, more particularly, preferably 4 to 7.

It is preferred that the bleaching-fixing solutions contain:

- bromides, such as, ammonium bromide, potassium bromide, and sodium bromide,
- bleaching accelerators, as described in JP-A-3-213853 (the 19th line of left lower column to the 13th line of right lower column of page 5), and
- stainless corrosion inhibitors, such as, ammonium nitrate and potassium nitrate.

It is also preferred that organic acids be added as pH buffering agents to maintain the pH in a preferred range.

Examples of such organic acids include those which can be used in the bleaching solutions as described above. Particularly preferred are acetic acid, glycolic acid, lactic acid, and citric acid.

The bleaching-fixing solution may contain the compounds of general formulas (I) or (II) which are not complexed with the iron salts, and aminopolycarboxylic acids, such as, ethylenediaminetetraacetic acid.

It is preferred that the concentration of ammonium ion in the processing solutions having bleaching ability according to the present invention is reduced to decrease environmental pollution, and to reduce the amount of crystal precipitated on the inner wall of the processing bath, and thereby facilitate the maintenance of the processors. Concretely, it is preferred that the concentration of ammonium ion is reduced to 0.3 mol/l or lower, particularly preferably 0.1 mol/l or lower. It is most preferred that the processing solutions are completely free from ammonium ion.

A lowering in the concentration of ammonium ion in conventional processing solutions having bleaching ability causes the retardation of the bleaching rate. In the present invention, the bleaching rate is not affected such a reduction in the concentration of ammonium ion.

A specific method for reducing ammonium ion is that a cation other than ammonium (for example, bromides, nitrates, thiosulfates, and sulfites) is used as a countercation for iron(III) complex salts. Namely, potassium bromide, sodium bromide, sodium thiosulfate, and sodium sulfite are used. In the case of the iron(III) complex salts, sodium salt and potassium salt are used.

It is particularly preferred that the processing solutions having bleaching ability are aerated when processing is conducted. When the concentrations of the iron(III) complex salts of the organic acids are low, it is particularly important that bleaching ability is always restored by oxidation by air. Aeration can be carried out by means conventional in the art. For example, aeration can be carried out by blowing air into the processing solutions having bleaching ability, or by allowing air to be absorbed by the solutions by utilizing an ejector.

It is preferred that, when air is blown into the solutions, air is discharged into the solutions through an air diffusing pipe having fine pores. Such air diffusing pipe is widely used in aeration tanks in activated sludge processes. Aeration is described in Z-121, *Using Process C-41*, Third Edition (1982), pp. BL-1 to BL-2, published by Eastman Kodak.

It is preferred that intense stirring is carried out during processing with the processing solutions having bleaching ability according to the present invention. With regard to stirring, the stirring procedure described in JP-A-3-33847 (the 6th line of right upper column to the second line of left lower column of page 8) can be used, as such. A particularly preferred method is to use a jet stirring system wherein the solutions having bleaching ability are allowed to collide with the emulsion layer surface of the light-sensitive material.

The replenishment rate of the processing solution is 50 to 1,000 ml, and preferably 60 to 600 ml per $m^2$ of the light-sensitive material.

The processing solutions having bleaching ability can be reused by recovering overflow solution obtained by processing and adding ingredients thereto to correct the composition thereof. It is preferred that the bleaching-fixing solution is reused after the recovery of silver by conventional methods. This method of reuse is called regeneration. Such regeneration can advantageously be carried out in the present invention. The details of regeneration are described in *Fuji Film Processing Manual Fuji Color Negative Film CN-16 Processing* (revised August 1990) pp. 39–40, published by Fuji Photo Film Co., Ltd.

Any liquid materials and powders may be fed to a kit for preparing the processing solutions having bleaching ability according to the present invention. When ammonium salt is omitted, most of the starting materials are fed as powders, and the materials have low hygroscopicity, and hence powders can be easily prepared. It is preferred, from the viewpoint of reducing waste liquor, that powders are fed to a kit for regeneration, because materials can then be directly added without using any extra water.

In the present invention, the light-sensitive materials are processed with the bleaching solution, and then subjected to fixing processing, or bleaching-fixing processing. For this purpose, the fixing solutions or the bleaching-fixing solutions described in JP-A-3-33847 (the 16th line of right lower column of page 6 to the 15th line of left upper column of page 8) are preferably used.

Examples of the desilverization include the following stages:

Bleaching stage-fixing stage
Bleaching stage-rinsing stage-fixing stage
Bleaching stage-bleaching and fixing stage
Bleaching stage-rinsing stage-bleaching and fixing stage
Bleaching stage-bleaching and fixing stage-fixing stage
Bleaching and fixing stage It is preferred that intense stirring is carried out in the fixing stage, and in the bleaching-fixing stage, as in the bleaching stage. Concretely, the aforesaid jet stirring system is most preferred.

The replenishment rates of the fixing solution and the bleaching-fixing solution can be reduced and these solutions can be reused by removing silver from these solutions by conventional methods.

In the processing carried out according to the present invention, a color development stage is carried out before conducting processing with the processing solutions having bleaching ability.

Color developing solutions described in JP-A-3-33847 (the sixth line of the left upper column of page 9 to the sixth line of the right lower column of page 11) is preferably used in the present invention. Specifically, processing agents for color negative films, such as, color developing solutions and replenishers, for example, CN-16, CN-16X, CN-16Q and CN-16FA (manufactured by Fuji Photo Film Co., Ltd.) and processing agents for color negative films, such as, color developing solutions and replenishers, for example, C-41, C-41B and C-41RA (manufactured by Eastman Kodak) can be preferably used.

After the desilverization stage, the rinsing stage and/or the stabilization stage are usually carried out in the present invention.

The rinsing stage and/or the stabilization stage, as described in JP-A-3-33847 (the 9th line of right lower column of page 11 to the 19th line of right upper column of page 12) are preferably used in carrying out the present invention.

Formaldehyde, as a stabilizing agent can be used in stabilizing solutions. However, from the viewpoint of the preservation of environment, it is preferred to use formaldehyde precursors, such as, hexamethylenetetramine, formaldehyde bisulfite adducts, and dimethylol urea and 1,4-bis(1,2,4-triazole-1-ylmethyl)piperazine.

The present invention can be applied to the processing of various color light-sensitive materials obtained by coating emulsions containing tabular silver iodobromide grains, such as, color negative films, reversal color films, reversal color paper and movie color negative films. However, the present invention can preferably be applied to the processing of the light-sensitive materials described in JP-A-3-33847 (the 20th line of right upper column of page 12 to the 17th line of right upper column of page 17).

The light-sensitive materials having a dry layer thickness of preferably not more than 20 μm, and, more preferably, not more than 18 μm, can be well-bleached. Further, light-sensitive materials having a high swelling rate are preferred. Concretely, light-sensitive materials as described in JP-A-3-33847 (the 7th line to the 14th line of left upper column of page 14), are particularly preferred.

It is particularly preferred that a compound capable of releasing a bleaching accelerator by reaction with aromatic primary amine color developing agents is contained in at least one layer of the silver halide emulsion layers of the silver halide color photographic material of the present invention.

Concretely, it is preferred that at least one silver halide emulsion layer contains a bleaching accelerator-releasing coupler as described in JP-A-61-201247, whereby very rapid bleaching can be achieved even when the concentration of the iron(III) complex salt of the present invention is low.

Bleaching accelerator-releasing couplers having an eliminable group represented by the following general formula (C) are particularly preferred:

$$-(S-T)_g-S-L-COOH \qquad (C),$$

wherein L represents an alkylene group; T represents a bivalent heterocyclic group; and g represents 0 to 1.

The alkylene group represented by L may be a straight-chain, branched or cyclic group and has preferably 1 to 6 carbon atoms. A straight-chain alkylene group having 1 to 4 carbon atoms is more preferred. Examples of the bivalent heterocyclic group represented by T include tetrazole and thiadiazole, and g is preferably 0.

The host nucleus of the couplers may be any of cyan, magenta and yellow couplers. Usually, it is preferred that the bleaching accelerator-releasing couplers are cyan couplers, because color light-sensitive materials containing tabular silver iodobromide grains are usually photographic materials for photographing, and bleaching of the red-sensitive layer of the lowermost layer is most retarded.

Examples of cyan couplers having an eliminable bleaching accelerator group, include the following types: naphthol, ureide, 2,5-diacylamino, 5-amidonaphthol, pyrazolotriazole, pyrrolotriazoale, pyrrole, imidazole, and pyrrolpyrazole cyan couplers.

Among them, the naphthol and 2,5-diacylamino type cyan couplers are preferred, and the naphthol type cyan couplers are particularly preferred.

It is to be expected that the accelerating bleaching effect can be increased when the bleaching agents are used in combination with the bleaching accelerator-releasing couplers. When the iron(III) complex salts of the present invention are used in combination with the bleaching accelerator-releasing couplers, it has been found that rapid processing can be achieved to a degree not expected from the combination of the bleaching accelerator-releasing couplers with conventional bleaching agents, such as, (ethylenediaminetetraacetato)iron(III) complex salt and (1,3-diaminopropanetetraacetato)iron(III) complex salt.

The bleaching accelerator-releasing couplers are used in an amount of preferably $1\times10^{-5}$ to 1.0 mol, and, more particularly, preferably $1\times10^{-4}$ to 0.5 mol per mol of silver contained in the same layer or in the adjoining layer.

Examples of the bleaching accelerator-releasing couplers which can be preferably used in the present invention include the following compounds:

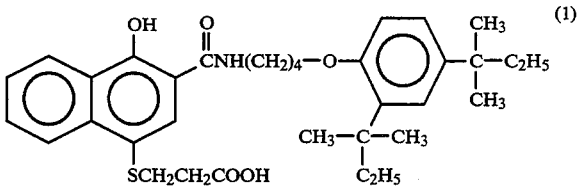
(1)

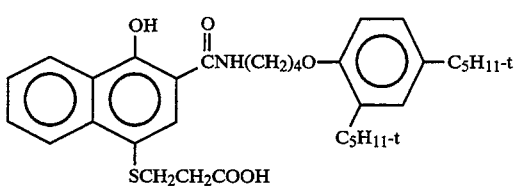
(2)

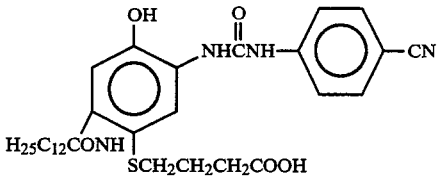
(3)

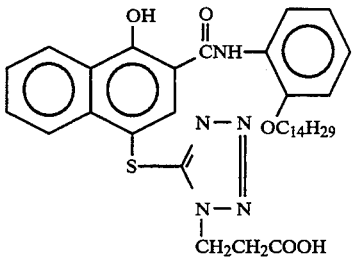
(4)

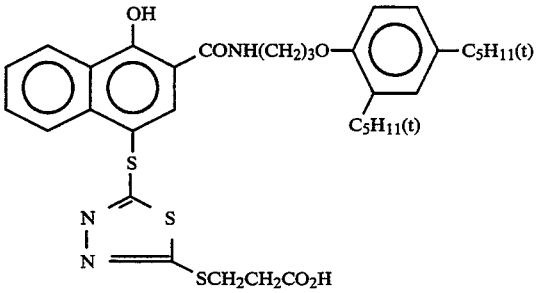
(5)

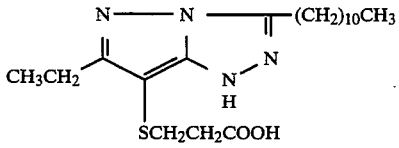
(6)

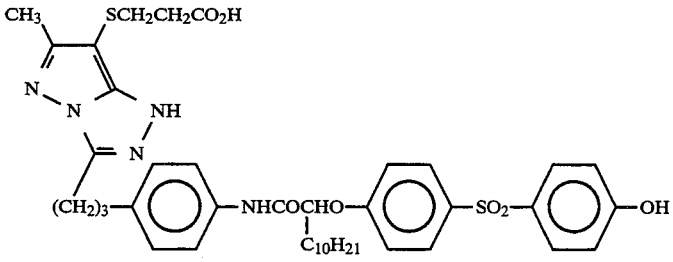
(7)

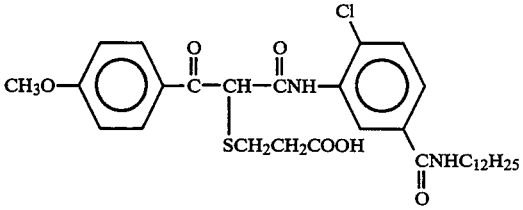
(8)

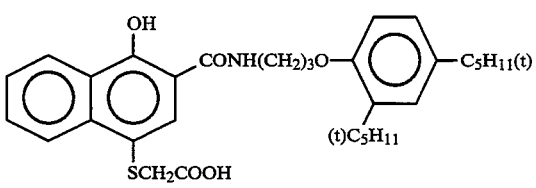
(9)

The present invention is now illustrated in greater detail by reference to the following examples which, however, are not to be construed as limiting the present invention in any way.

EXAMPLE 1

The following layers having the following compositions were coated on an undercoated cellulose triacetate film support to prepare a multi-layer color light-sensitive material identified as Sample 101.

Composition of Light-Sensitive Layer

Following abbreviations for principal ingredients used in the following layers are used for brevity's sake.

ExC: cyan coupler
ExM: magenta coupler
ExY: yellow coupler
ExS: sensitizing dye
UV: ultraviolet light absorber
HBS: high-boiling organic solvent
H: hardening agent for gelatin Numerals represent coating weight are g/m$^2$. The amounts of silver halide emulsions are represented by coating weight in terms of silver. The amounts of sensitizing dyes are represented by moles per one mole of silver halide in the same layer.

| Sample 101 | |
|---|---|
| First Layer (antihalation layer) | |
| Black colloidal silver (in terms of silver) | 0.18 |
| Gelatin | 1.40 |
| ExM-1 | 0.18 |
| ExF-1 | $2.0 \times 10^{-3}$ |
| HBS-1 | 0.20 |
| Second Layer (interlayer) | |
| Emulsion G (in terms of silver) | 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer (low-sensitivity red-sensitive emulsion layer) | |
| Emulsion A (in terms of silver) | 0.25 |
| Emulsion B (in terms of silver) | 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.0050 |
| ExC-7 | 0.0050 |
| ExC-8 | 0.010 |
| Cpd-2 | 0.025 |
| HBS-1 | 0.10 |
| Gelatin | 0.87 |
| Fourth Layer (intermediate-sensitivity red-sensitive emulsion layer) | |
| Emulsion D (in terms of silver) | 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-6 | 0.0050 |
| ExC-7 | 0.0010 |
| ExC-8 | 0.0070 |
| Cpd-2 | 0.023 |
| HBS-1 | 0.10 |
| Gelatin | 0.75 |
| Fifth Layer (high-sensitivity red-sensitive emulsion layer) | |
| Emulsion E (in terms of silver) | 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer (interlayer) | |
| Cpd-1 | 0.10 |
| HBS-1 | 0.50 |
| Gelatin | 1.10 |
| Seventh Layer (low-sensitivity green-sensitive emulsion layer) | |
| Emulsion C (in terms of silver) | 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |

-continued

| Sample 101 | |
|---|---|
| HBS-1 | 0.30 |
| HBS-3 | 0.010 |
| Gelatin | 0.76 |
| Eighth Layer (intermediate-sensitivity green-sensitive emulsion layer) | |
| Emulsion D (in terms of silver) | 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth Layer (high-sensitivity green-sensitive emulsion layer) | |
| Emulsion E (in terms of silver) | 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth Layer (yellow filter layer) | |
| Yellow colloidal silver (in terms of silver) | 0.030 |
| Cpd-1 | 0.16 |
| HBS-1 | 0.60 |
| Gelatin | 0.60 |
| Eleventh Layer (low-sensitivity blue-sensitive emulsion layer) | |
| Emulsion C (in terms of silver) | 0.18 |
| ExS-7 | $8.6 \times 10^{-4}$ |
| ExY-1 | 0.020 |
| ExY-2 | 0.022 |
| ExY-3 | 0.050 |
| ExY-4 | 0.020 |
| HBS-1 | 0.28 |
| Gelatin | 1.10 |
| Twelfth Layer (intermediate-sensitivity blue-sensitive emulsion layer) | |
| Emulsion D (in terms of silver) | 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth Layer (high-sensitivity blue-sensitive emulsion layer) | |
| Emulsion F (in terms of silver) | 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer (first protective layer) | |
| Emulsion G (in terms of silver) | 0.20 |
| UV-4 | 0.11 |
| UV-5 | 0.17 |
| HBS-1 | $5.0 \times 10^{-2}$ |
| Gelatin | 1.00 |
| Fifteenth Layer (second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, each layer contained W-1 to W-3, B-4 to B-6, F-1 to F-17, iron salt, lead salt, gold salt, platinum salt, iridium salt and rhodium salt to improve preservability, processability, pressure resistance, antifungal and antibacterial properties, antistatic properties and coatability. Sample 101 had a dry layer thickness of 19 μ.

TABLE 1

| Emulsion | Average AgI Content (%) | Mean Grain Size (μm) | Coefficient of Variation in Grain Size (%) | Aspect Ratio | Ratio of Amount of Silver [Core/Intermediate/Shell] (AgI Content) | Grain Structure/Form |
|---|---|---|---|---|---|---|
| A | 4.0 | 0.45 | 27 | 1 | [1/3] (13/1) | Double structural octahedral grains |
| B | 8.9 | 0.70 | 14 | 1 | [3/7] (25/2) | Double structural octahedral grains |
| C | 2.0 | 0.50 | 20 | 9 | — | Uniform structural tabular grains |
| D | 9.0 | 0.65 | 25 | 6 | [12/59/29] (0/11/8) | Triple structural tabular grains |
| E | 9.0 | 0.85 | 23 | 5 | [8/59/33] (0/11/8) | Triple structural tabular grains |
| F | 14.5 | 1.25 | 25 | 3 | [37/63] (34/3) | Double structural plate grains |
| G | 1.0 | 0.07 | 15 | 1 | — | Uniform structural fine grains |

In Table 1, the following should be noted:

(1) Emulsions A to F were reduction-sensitized during the preparation of the grains by using thiourea dioxide and thiosulfinic acid, according to Examples of JP-A-2-191938.

(2) Emulsions A to F were subjected to gold sensitization, sulfur sensitization, and selenium sensitization in the presence of sodium thiocyanate, and spectral sensitizing dyes, as described in each light-sensitive layer, according to Examples of Japanese Patent Application No. 3-237450.

(3) Tabular grains were prepared by using low-molecular gelatin, according to Examples of JP-A-1-158426.

(4) Tabular grains and normal crystal grains having a grain structure showed that dislocation lines as described in JP-A-3-237450, were observed through a high-voltage electron microscope.

(5) Emulsions C, D, E and F contained tabular silver iodobromide grains having an aspect ratio of not lower than 3, according to the present invention.

The following are the Compounds used in the above described Sample 101:

ExC-1

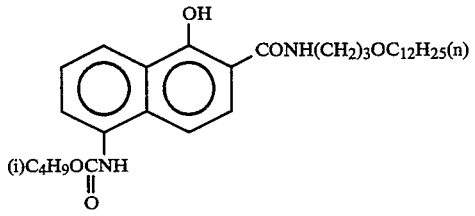

ExC-2

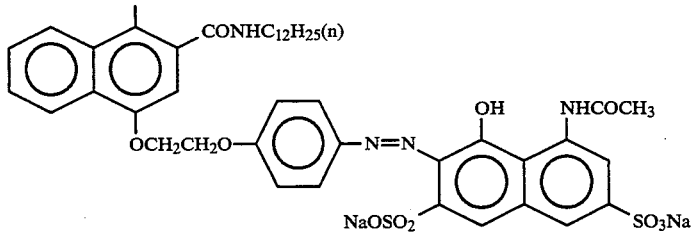

ExC-3

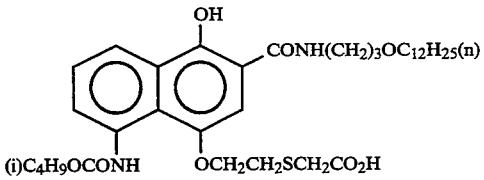

ExC-4

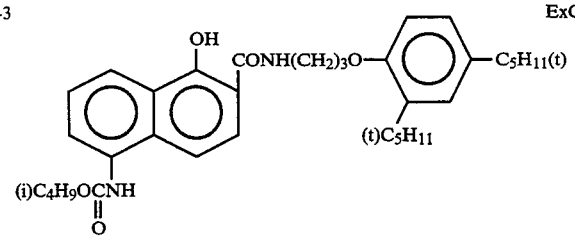

-continued
ExC-5
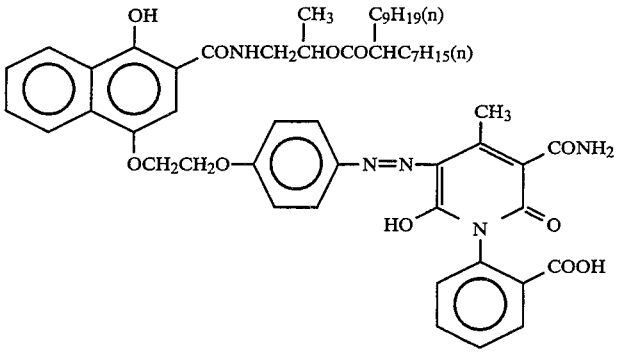
ExC-6
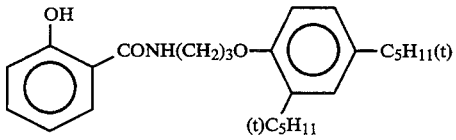
ExC-7
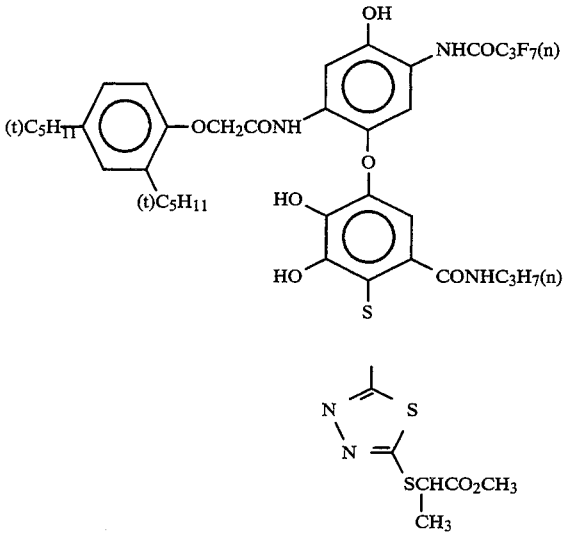
ExC-8
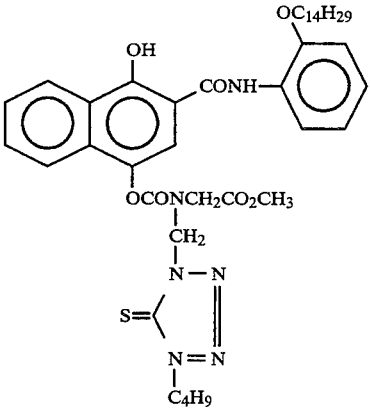

-continued
ExM-1
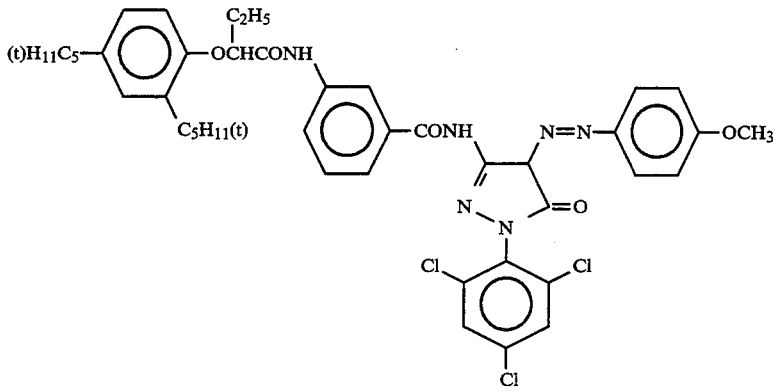
ExM-2
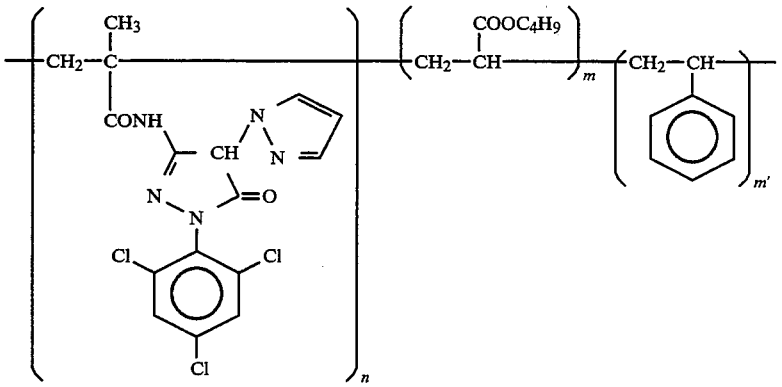
n = 50
m = 25
m' = 25
mol. wt. about 20,000
ExM-3
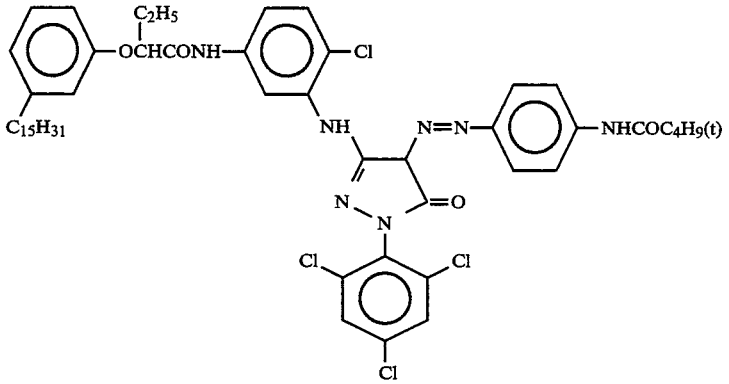
ExM-4
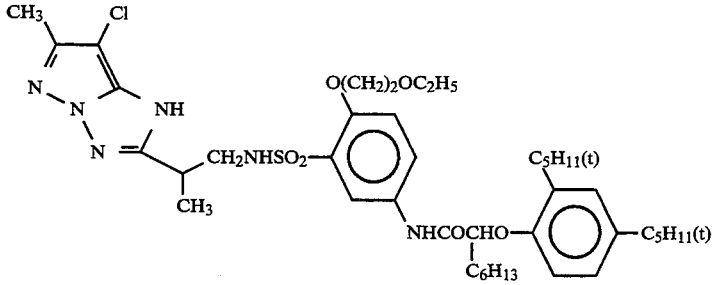

-continued
ExM-5
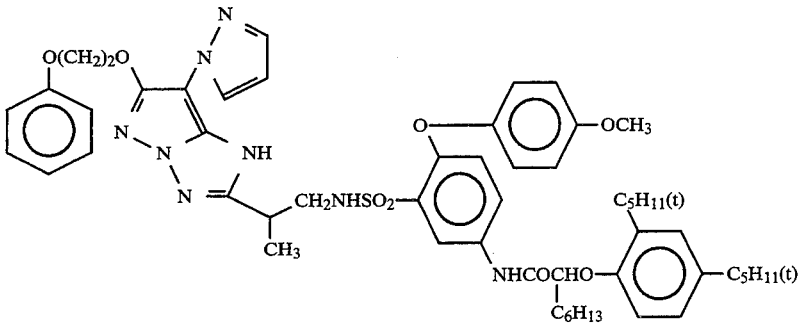
ExY-1
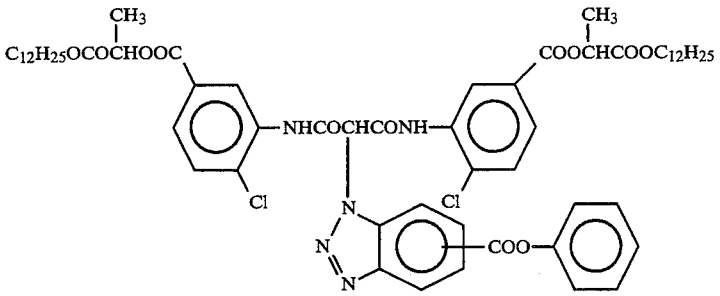
ExY-2
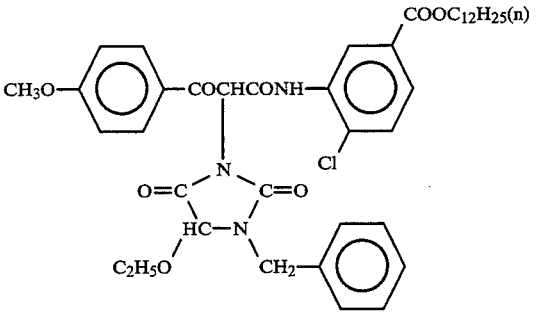
ExY-3
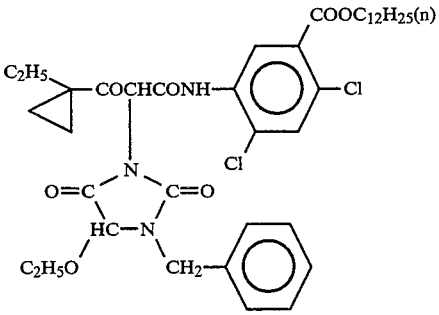
ExY-4
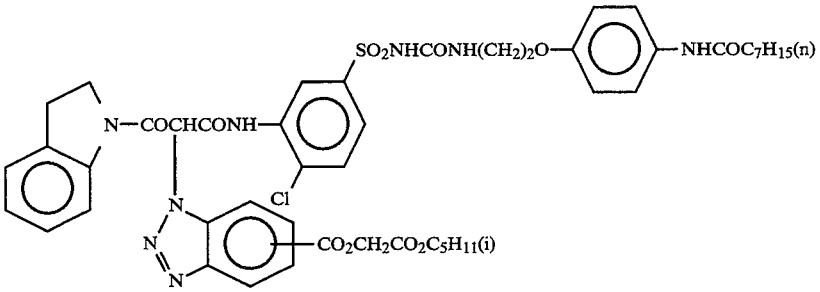
ExF-1
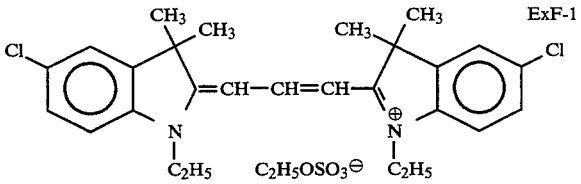
CPd-1
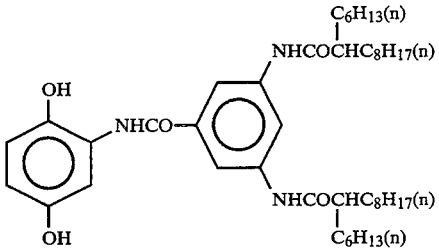

-continued
Cpd-2
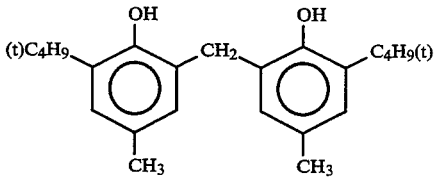
Cpd-3
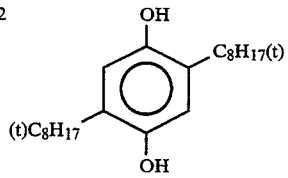
UV-1
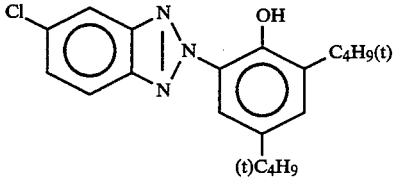
UV-2
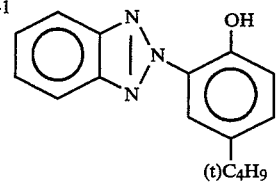
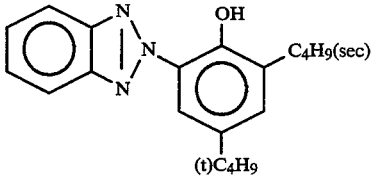
UV-3
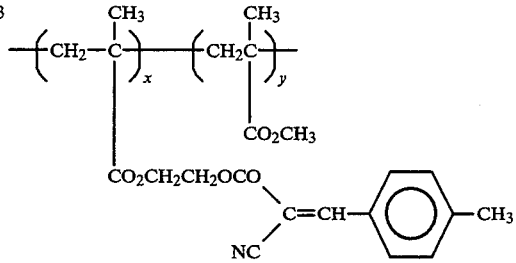
x:y = 70:30 (wt %)
UV-4
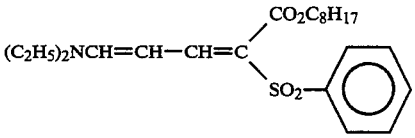
UV-5 Tricresyl phosphate
HBS-1
Di-n-butyl phthalate
HBS-2
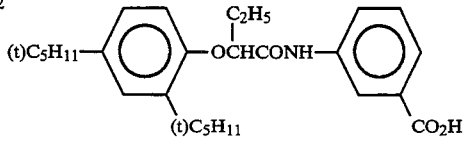
HBS-3
ExS-1
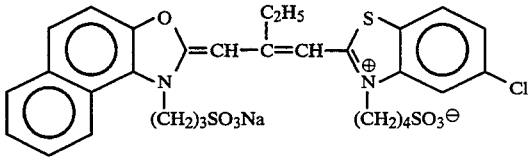
ExS-2
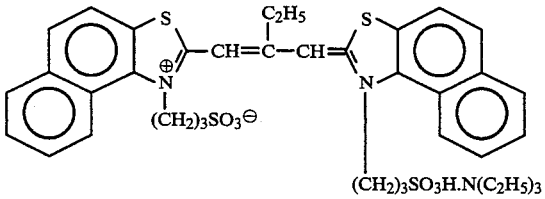
ExS-3
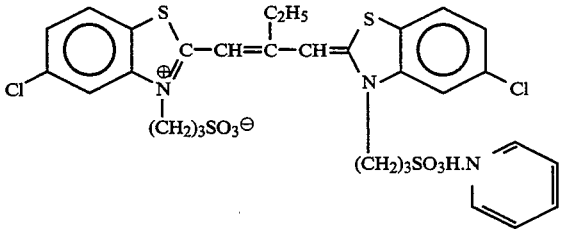
ExS-4
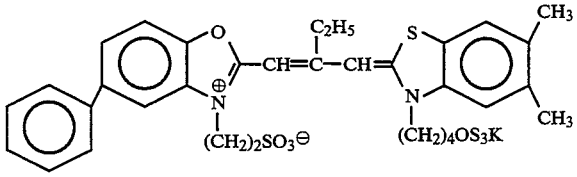
ExS-5
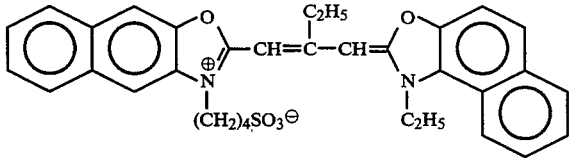
ExS-6
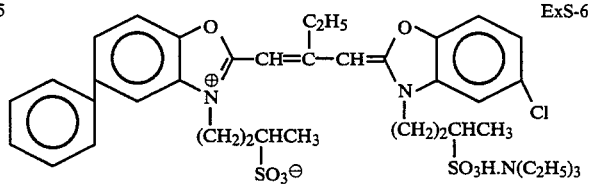

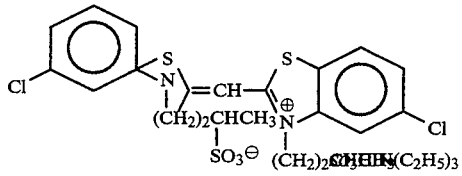
$CH_2{=}CH{-}SO_2{-}CH_2{-}CONH{-}CH_2$
$CH_2{=}CH{-}SO_2{-}CH_2{-}CONH{-}CH_2$
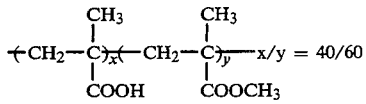
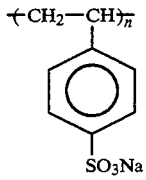
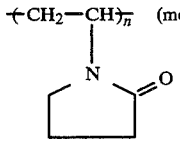
(mol. wt. about 10,000)
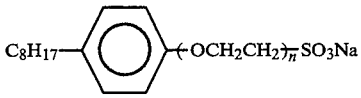
n = 2~4
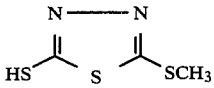
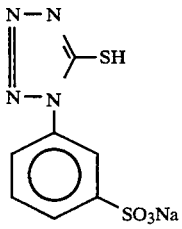
-continued
ExS-7
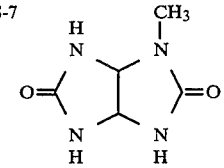
H-1
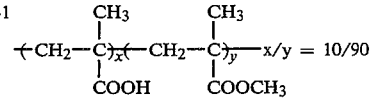
x/y = 10/90
B-2
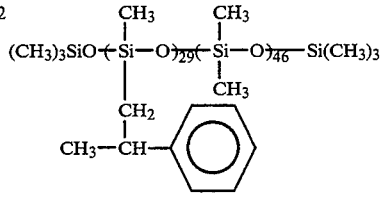
B-4
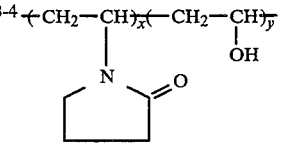
x/y = 70/30
B-6
$C_8F_{17}SO_2NHCH_2CH_2CH_2OCH_2CH_2\overset{\oplus}{N}(CH_3)_3$
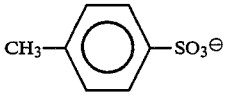
W-2
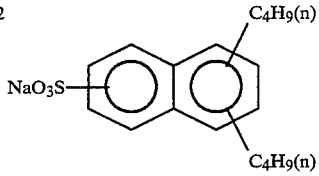
F-1
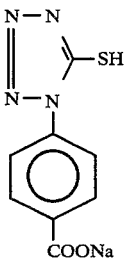
F-3
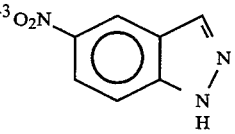
S-1
B-1
B-3
B-5
W-1
W-3
F-2
F-4

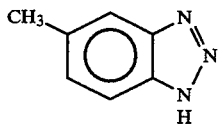

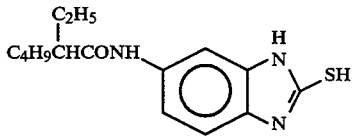

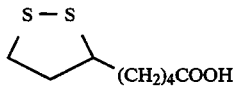

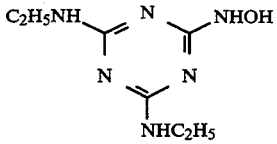

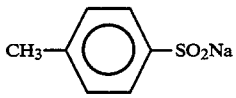

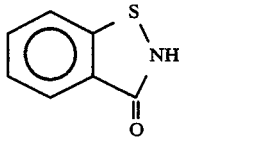

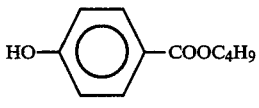

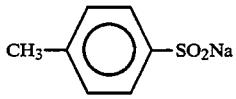

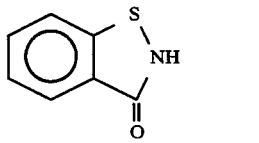

-continued

F-5

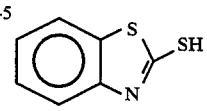

F-6

F-7

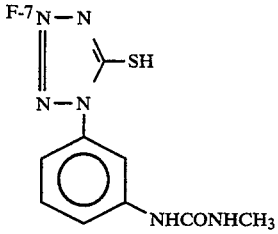

F-8

F-9

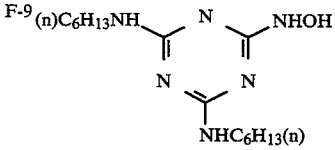

F-10

F-11

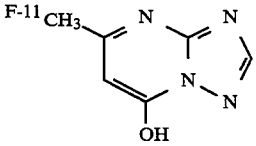

F-12

F-13

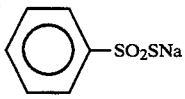

F-14

F-15

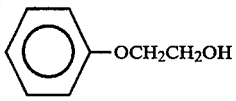

F-16

F-17

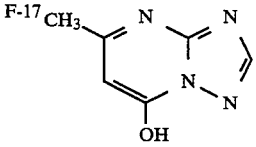

F-12

F-13

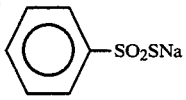

F-14

F-15

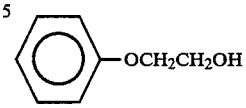

F-16

F-17

The fourth layer (intermediate-sensitivity red-sensitive emulsion layer), the fifth layer (high-sensitivity red-sensitive emulsion layer), the seventh layer (low-sensitivity green-sensitive emulsion layer), the eighth layer (intermediate sensitivity green-sensitive layer), the ninth layer (high-sensitivity green-sensitive emulsion layer), the eleventh layer (low-sensitivity blue-sensitive emulsion layer), the twelfth layer (intermediate-sensitivity blue-sensitive emulsion layer) and the thirteenth layer (high-sensitivity blue-sensitive emulsion layer) of the thus-prepared Sample 101 contained tabular silver iodobromide grains having an aspect ratio of not lower than 3 according to the present invention.

Sample 101 was cut into test pieces of 35 mm in width, subjected to whole surface exposure to light (20 CMS; color temperature: 4800° K.) and processed with the processing solutions having bleaching ability according to the present invention, and comparative processing solutions having bleaching ability to evaluate bleaching performance, and color restoration performance.

Evaluation of Bleaching Performance

The amount of residual silver in the sample, after processing, was measured by means of X-ray fluorometry. A lower amount of residual silver, after processing, means a better bleaching performance.

Evaluation of Color Restoration Performance

The density was measured by using an X-light type photographic densitometer. Subsequently, the sample was re-bleached with the bleaching solution CN-16X.N2X for color negative film (manufactured by Fuji Photo Film Co., Ltd.) for 3 minutes, rinsed for 3 minutes, and dried. After drying, the density was again measured. A degree of failure in color restoration was calculated from the following formula:

$$\text{A degree of failure in restoration of color} = (D_R - D_{RO}) + (D_{GO} - D_G)$$

$D_R$: red transmission density, after rebleaching
$D_{RO}$: red transmission density, before rebleaching
$D_G$: green transmission density, after rebleaching
$D_{GO}$: green transmission density, before rebleaching Each Processing numbered 1–13 was carried out in the following manner:

The temperature of each processing was such that the temperature of the processing solution was 38° C., that of the rinsing solution was 24° C., and that of the drying step temperature was 55° C.

The replenishment rate per 1 m long by 35 mm wide of the Sample 101, for the color developing solution, was 22 ml and for each of the bleaching solution, the bleaching-fixing solution, the fixing solution, and the stabilizing solution, was 25 ml.

Each processing had the following processing stages:

TABLE 2

| Stage | Processing 1 | 2 | 3 | 4 | 5 | 6–11 | 12–13 |
|---|---|---|---|---|---|---|---|
| Color development | 3'15" | 3'15" | 3'15" | 3'15" | 3'15" | 3'15" | 3'15" |
| Bleaching | 2'00" | 2'00" | 2'00" | 2'00" | — | 2'00" | — |
| Bleaching-fixing | — | — | — | 2'00" | 4'00" | — | 4'00" |
| Fixing | 2'00" | 2'00" | 2'00" | — | — | 2'00" | — |
| Rinse 1 | 30" | 30" | 30" | 30" | 30" | 30" | 30" |
| Rinse 2 | 30" | 30" | 30" | 30" | 30" | 30" | 30" |
| Stabilization | 30" | 30" | 30" | 30" | 30" | 30" | 30" |
| Drying | 2'00" | 2'00" | 2'00" | 2'00" | 2'00" | 2'00" | 2'00" |
| Remarks | Comp. Ex. | Comp. Ex. | Comp. Ex. | Comp. Ex. | Comp. Ex. | Invention | Invention |

A hyphen ("—") in Table 2 indicates that the related stage was omitted.

Each processing solution referred to in Table 2 had the following composition:

Color Developing Solution

| | Tank Solution (g) | Replenisher (g) |
|---|---|---|
| Diethylenetriaminepenta-acetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.3 |
| Potassium iodide | 1.5 mg | — |
| Hydroxylamine sulfate | 2.4 | 2.8 |
| 4-(N-ethyl-N-β-hydroxyethyl-amino)-2-methylaniline sulfate | 4.5 | 6.2 |
| Water to make | 1.0 liter | 1.0 liter |
| pH | 10.05 | 10.15 |

Stabilizing Solution
(Tank solution and replenisher being the same.) unit: g

| | |
|---|---|
| Sodium p-toluenesulfinate | 0.03 |
| Polyoxyethylene p-monononylphenyl ether (an average degree of polymerization: 10) | 0.2 |
| Disodium ethylenediaminetetraacetate | 0.05 |
| 1,2,4-Triazole | 1.3 |
| 1,4-Bis(1,2,4-triazole-1-ylmethyl)-piperazine | 0.75 |
| Water to make | 1.0 liter |
| pH | 8.5 |

Processing 1 (Comparative Example)

Bleaching Solution
(Tank solution and replenisher being the same.)

| | |
|---|---|
| The iron(III) complex salt of ethylenediaminetetraacetic acid | 0.15 mol/l |
| Sodium bromide | 0.50 mol/l |
| Sodium nitrate | 0.35 mol/l |
| Ammonia | 0.10 mol/l |
| pH | 6.0 |

Fixing Solution
(Tank solution and replenisher being the same.)

| | |
|---|---|
| Ammonium thiosulfate | 1.3 mol/l |
| Sodium sulfite | 0.15 mol/l |
| Acetic acid | 0.05 mol/l |
| pH | 6.6 |

Processing 2 (Comparative Example)

Bleaching accelerator A-1 [1,4-phenylenedimethylbis(2,2'-iminidiethanol)] which was considered to be effective in bleaching tabular silver iodobromide grains as described in U.S. Pat. No. 4,552,834, was added to the bleaching solution.

Bleaching Solution
(Tank solution and replenisher being the same.)

| | |
|---|---|
| Iron (III) complex salt of ethylene-diaminetetraacetic acid | 0.15 mol/l |
| Sodium bromide | 0.50 mol/l |
| Sodium nitrate | 0.35 mol/l |
| Ammonia | 0.10 mol/l |
| 1,4-Phenylenedimethylbis(2,2'-iminidiethanol) | 0.01 mol/l |

-continued

| Bleaching Solution (Tank solution and replenisher being the same.) | |
|---|---|
| pH | 6.0 |

Fixing Solution (Tank solution and replenisher being the same.)

The same fixing solution as that of processing 1 was used.

Processing 3 (Comparative Example)

Bleaching agent, iron(III) complex salt of 1,3-diaminopropanetetraacetic acid, which was considered to be effective in bleaching tabular silver iodobromide grains, as described in JP-A-2-46448, was added to the bleaching solution.

| Bleaching Solution (Tank solution and replenisher being the same.) | |
|---|---|
| Iron (III) complex salt of 1,3-diamino-propanetetraacetic acid | 0.15 mol/l |
| Sodium bromide | 0.50 mol/l |
| Sodium nitrate | 0.35 mol/l |
| Acetic acid | 0.85 mol/l |
| Ammonia | 0.15 mol/l |
| pH | 4.3 |

Fixing Solution (Tank solution and replenisher being the same.)

The same fixing solution as that of processing 1 was used.

Processing 4 (Comparative Example)

In the desilverization stage, there were used a bleaching solution and a bleaching-fixing solution, which were considered to be effective in processing tabular silver iodobromide grains, as described in JP-A-62-91953.

| Bleaching Solution (Tank solution and replenisher being the same.) | |
|---|---|
| Iron (III) complex salt of ethylene-diaminetetraacetic acid | 0.15 mol/l |
| Sodium bromide | 0.50 mol/l |
| Sodium nitrate | 0.35 mol/l |
| Ammonia | 0.10 mol/l |
| pH | 6.0 |

| Bleaching-fixing Solution (Tank solution and replenisher being the same.) | |
|---|---|
| Ammonium thiosulfate | 1.3 mol/l |
| Sodium sulfite | 0.15 mol/l |
| Iron(III) complex salt of ethylene-diaminetetraacetic acid | 0.15 mol/l |
| pH | 6.8 |

Processing 5 (Comparative Example)

In the desilverization stage there was used a bleaching-fixing solution, which was considered to be effective in processing tabular silver iodobromide grains, as described in JP-A-61-17143.

| Bleaching-fixing Solution (Tank solution and replenisher being the same.) | |
|---|---|
| Ammonium thiosulfate | 1.3 mol/l |
| Sodium sulfite | 0.15 mol/l |
| Iron(III) complex salt of ethylene-diaminetetraacetic acid | 0.15 mol/l |
| Ammonia | 0.09 mol/l |
| pH | 7.0 |

Processing 6 (Invention)

| Bleaching Solution (Tank solution and replenisher being the same.) | |
|---|---|
| Iron(III) complex salt of compound (1) of invention | 0.15 mol/l |
| Sodium bromide | 0.50 mol/l |
| Sodium nitrate | 0.35 mol/l |
| Acetic acid | 0.80 mol/l |
| Ammonia | 0.15 mol/l |
| pH | 4.3 |

Fixing Solution (Tank solution and replenisher being the same.)

The same processing solution as that of Processing 1 was used.

| Processing 7 (Invention) Bleaching Solution (Tank solution and replenisher being the same.) | |
|---|---|
| Iron(III) complex salt of compound (18) of invention | 0.15 mol/l |
| Sodium bromide | 0.50 mol/l |
| Sodium nitrate | 0.35 mol/l |
| Ammonia | 0.15 mol/l |
| pH | 6.0 |

Fixing Solution (Tank solution and replenisher being the same.)

The same processing solution as that of Processing 1 was used.

| Processing 8 (Invention) Bleaching Solution (Tank solution and replenisher being the same.) | |
|---|---|
| Iron(III) complex salt of compound (8) of invention | 0.15 mol/l |
| Sodium bromide | 0.50 mol/l |
| Sodium nitrate | 0.35 mol/l |
| Ammonia | 0.15 mol/l |
| pH | 6.0 |

Fixing Solution (Tank solution and replenisher being the same.)

The same fixing solution as that of Processing 1 was used.

| Processing 9 (Invention) Bleaching Solution (Tank solution and replenisher being the same.) | |
|---|---|
| Iron(III) complex salt of compound (60) of invention | 0.15 mol/l |
| Sodium bromide | 0.50 mol/l |
| Sodium nitrate | 0.35 mol/l |
| Acetic acid | 0.50 mol/l |
| Ammonia | 0.15 mol/l |
| pH | 4.5 |

Fixing Solution (Tank solution and replenisher being the same.)

The same fixing solution as that of Processing 1 was used.

| Processing 10 (Invention) Bleaching Solution (Tank solution and replenisher being the same.) | |
|---|---|
| Iron(III) complex salt of compound (48) of invention | 0.15 mol/l |
| Sodium bromide | 0.50 mol/l |
| Sodium nitrate | 0.35 mol/l |
| Acetic acid | 0.50 mol/l |
| Ammonia | 0.15 mol/l |
| pH | 4.5 |

Fixing Solution (Tank solution and replenisher being the same.)

The same fixing solution as that of Processing 1 was used.

| Processing 11 (Invention) Bleaching Solution (Tank solution and replenisher being the same.) | |
|---|---|
| Iron(III) complex salt of compound (40) of invention | 0.15 mol/l |
| Sodium bromide | 0.50 mol/l |
| Sodium nitrate | 0.35 mol/l |
| Acetic acid | 0.50 mol/l |
| Ammonia | 0.15 mol/l |
| pH | 4.5 |

Fixing Solution (Tank solution and replenisher being the same.)

The same fixing solution as that of Processing 1 was used.

| Processing 12 (Invention) Bleaching-fixing Solution (Tank solution and replenisher being the same.) | |
|---|---|
| Ammonium thiosulfate | 1.3 mol/l |
| Sodium sulfite | 0.15 mol/l |
| Iron(III) complex salt of compound (18) of invention | 0.15 mol/l |
| Ammonia | 0.09 mol/l |
| pH | 6.5 |

| Processing 13 (Invention) Bleaching-fixing Solution (Tank solution and replenisher being the same.) | |
|---|---|
| Ammonium thiosulfate | 1.3 mol/l |
| Sodium sulfite | 0.15 mol/l |
| Iron(III) complex salt of compound (19) of invention | 0.15 mol/l |
| Ammonia | 0.09 mol/l |
| pH | 6.5 |

The processing results are shown in Table 3.

TABLE 3

| Processing | Amount of Residual Silver ($\mu m/cm^2$) | Degree of Failure in Color Restoration | Remarks |
|---|---|---|---|
| 1 | 45 | 0.08 | Comp. Ex. |
| 2 | 38 | 0.08 | " |
| 3 | 14 | 0.07 | " |
| 4 | 35 | 0.05 | " |
| 5 | 63 | 0.11 | " |
| 6 | 2.0 | 0.00 | Invention |
| 7 | 2.7 | 0.00 | " |
| 8 | 3.5 | 0.01 | " |
| 9 | 4.0 | 0.02 | " |
| 10 | 4.5 | 0.03 | " |
| 11 | 4.2 | 0.03 | " |
| 12 | 3.0 | 0.00 | " |
| 13 | 3.5 | 0.01 | " |

It is usually considered that there is no problem when the amount of residual silver is not more than 5 $\mu g/cm^2$.

Further, it is considered that there is practically no problem when the degree of failure in color restoration is not higher than 0.03.

It can be seen from Table 3 that the amount of residual silver, as well as the degree of failure in color restoration in Processings 1 to 6 are beyond a tolerance level, and processings 1 to 5 can not be put to practical use, while the amount of residual silver as well as the degree of failure in color restoration in the processings 6 to 13 of the present invention are within the scope of the tolerance level, and processing according to the present invention produces excellent effects which can not be achieved by conventional processing.

EXAMPLE 2

Each of bleaching solutions A to D was prepared in the same manner as in Example 1, except that the concentration of ammonium ion was changed by using ammonium bromide in place of sodium bromide in the bleaching solution of Processing 6, and using sodium hydroxide in place of ammonia in the bleaching solution of Processing 6. In the same manner as in Processing 6 of Example 1, processing was carried out by using each bleaching solution. Similarly, each of bleaching solutions E to H was prepared by changing the concentration of ammonium ion in the bleaching solution of Processing 7 in the same manner as described above. In the same manner as in Processing 7 of Example 1, processing was carried out by using each bleaching solution. For the purpose of comparison, each of bleaching solutions I to L was prepared by changing the concentration of ammonium ion in the bleaching solution of Processing 3 in the same manner as described above. In the same manner as in Processing 3 of Example 1, processing was carried out by using each processing solution. The precipitability of the bleaching solutions A to L on the inner wall of the processing tank was evaluated in the following manner.

Evaluation of Precipitation of Crystal

One liter of each of the bleaching solutions A to L was put into a container (inner size: 5 cm×10 cm×30 cm deep) made of polyvinyl chloride, and the container was placed in a constant temperature water bath at 40° C., and left to stand in the bath for one week.

After one week, the formation of the crystal precipitated on the inner wall and edge of the tank was observed, said crystal precipitated being formed by the bleaching solution ascending along the inner wall and the edge. The following ranking was made:

−: not precipitated on the inner wall, as well as on the edge.

+: slightly precipitated on the inner wall, but not precipitated on the edge.

++: precipitated on the inner wall, as well as on the edge.

The results are shown in Table 4.

TABLE 4

| Bleaching Solution | Concentration of Ammonium Ion (mol/l) | Amount of Residual Silver ($\mu g/cm^2$) | Degree of Failure in Color Restoration | Precipitation | Remarks |
|---|---|---|---|---|---|
| A | 0.0 | 3.3 | 0.01 | – | Invention |
| B | 0.1 | 3.0 | 0.00 | – | " |
| C | 0.3 | 3.0 | 0.00 | + | " |
| D | 0.5 | 3.2 | 0.00 | ++ | " |
| E | 0.0 | 3.5 | 0.01 | – | " |
| F | 0.1 | 3.5 | 0.01 | – | " |
| G | 0.3 | 3.7 | 0.01 | + | " |
| H | 0.5 | 3.8 | 0.02 | ++ | " |
| I | 0.0 | 26.5 | 0.10 | + | Comp. Ex. |
| J | 0.1 | 14.0 | 0.08 | + | " |
| K | 0.3 | 11.0 | 0.06 | ++ | " |
| L | 0.5 | 9.1 | 0.05 | ++ | " |

It can be seen from Table 4 that, even when the concentration of ammonium ion is reduced, the bleaching performance, as well as color restoration performance in the present invention are not changed, and the present invention has effect that reduction of ammonium ion decreases crystal precipitation.

On the other hand, the Comparative Examples show that a reduction in the concentration of ammonium ion causes a further lowering in bleaching performance, and the problem with regard to crystal precipitation is not much improved. It is considered that the effect of preventing crystal precipitation when the concentration of ammonium ion is reduced is a feature of the present invention.

EXAMPLE 3

Samples 102, 103 and 104 were prepared in the same manner as in the preparation of Sample 101, except that an equimolar amount of each of the bleaching accelerator releasing type couplers (2), (3) and (9) was used in place of ExC-6 used in the third, fourth and fifth layers of the Sample 101.

The samples were processed in the same manner as in Example 1, except that the concentration of the iron(III) complex salt in each of Processing 3 (Comparative Example), Processing 6 (Invention), Processing 10 (Invention), and Processing 12 (Invention) of Example 1 was changed as indicated in Table 5 to examine the effect on the bleaching performance (amount of residual silver).

The change of pH caused by the change of the concentration of the iron(III) complex was corrected by using acetic acid and ammonia water.

The results are shown in Table 5

TABLE 5

| Processing of Example 1 | Concentration of Iron(III) Complex Salt (mol/l) | Sample | Amount of Residual Silver | Remarks |
|---|---|---|---|---|
| 3 | 0.15 | 101 | 14 | Comp. Ex. |
| | | 102 | 11 | |
| | | 103 | 12 | |
| | | 104 | 12 | |
| 6 | 0.08 | 101 | 12 | Invention |
| | | 102 | 3.0 | |
| | | 103 | 3.6 | |
| | | 104 | 3.3 | |
| 6 | 0.15 | 101 | 2.0 | Invention |
| | | 102 | 1.0 | |
| | | 103 | 1.5 | |
| | | 104 | 2.0 | |
| 10 | 0.08 | 101 | 16 | Invention |
| | | 102 | 4.2 | |
| | | 103 | 4.6 | |
| | | 104 | 4.4 | |

TABLE 5-continued

| Processing of Example 1 | Concentration of Iron(III) Complex Salt (mol/l) | Sample | Amount of Residual Silver | Remarks |
|---|---|---|---|---|
| 12 | 0.10 | 101 | 13 | Invention |
| | | 102 | 2.8 | |
| | | 103 | 3.6 | |
| | | 104 | 3.4 | |

As shown in Table 5, the combination of the bleaching accelerator releasing coupler with the iron(III) complex salt of the present invention produces a remarkable bleaching accelerating effect in comparison with the Comparative Examples.

Further, it is shown that when the bleaching accelerator releasing couplers are used, bleaching can be accomplished in a short period of time in the present invention, even when by using a bleaching solution containing the iron(III) complex salt at a concentration as low as 0.08 mol/l, or a bleaching-fixing solution containing the iron(III) complex salt at a concentration as low as 0.1 mol/l.

It will be understood from the above disclosure that according to the present invention photographic materials for photographing containing tabular silver iodobromide grains can be processed by using a low-concentration bleaching agent, without causing a failure in desilverization, whereby the amount of the iron(III) complex salt of the organic acid discharged can be reduced, and the processing can be conducted in a way which scarcely causes environmental pollution.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material comprising a support having thereon at least one silver halide emulsion layer, which comprises color developing in a color developing solution containing a color developing agent, and then processing with a processing solution having a bleaching ability, characterized by a) said silver halide emulsion layer containing silver halide grains having a composition in which tabular silver iodobromide grains having an aspect ratio of not lower than 3 account for at least 50% of the entire projected area of said silver halide grains, and b) said processing solution having a bleaching ability contains an iron (III) complex salt of a compound represented by the following general formula (I) as a bleaching agent at a concentration of 0.01 to 0.17 mol/liter:

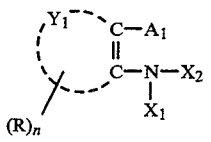

(I)

wherein $Y_1$ represents a non-metallic atomic group required for forming an arylene group;

R represents a substituent group selected from the group consisting of an alkyl group, an aralkyl group, an alkenyl group, an alkynyl group, an aryl group, a sulfonamide group, a ureido group, a urethane group, an aryloxy group, a sulfamoyl group, an alkylthio group, an arylthio group, a sulfonyl group, a sulfinyl group, an acyl group, a hydroxy group, a halogen atom, a cyano group, a sulfo group, a carboxyl group, a phosphono group, an aryloxycarbonyl group, an alkoxycarbonyl group; an acyloxy group, a nitro group and a hydroxamic acid group;

n represents 0 or an integer of 1 to 4, provided that when n is 2 to 4, two or more R groups may be the same or different;

$X_1$ represents a hydrogen atom or $—L_1—A_2$;

$X_2$ represents a substituent selected from the group consisting of $—L_2—A_3$ and a group of the following formula

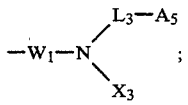

;

$X_3$ represents a hydrogen atom, or a substituent selected from the group consisting of a hydroxyalkyl group and $—L_4—A_4$;

$A_1$ and $A_5$ each represents a hydrogen atom, or a substituent selected from the group consisting of a carboxyl group, a sulfo group, an alkylthio group and $S—L_5—COOH$;

$A_2$ represents a substituent selected from the group consisting of a carboxyl group and a sulfo group;

$A_3$ and $A_4$ each represents a carboxyl group;

$L_2$, $L_4$ and $L_5$ each represents an alkylene group;

$L_1$ and $L_3$ each represents a substituent selected from the group consisting of an alkylene group and an arylene group; and $W_1$ represents a bivalent bonding group represented by the following general formula (W)

$$—W_2\text{-}(X—W_3)_c\text{-} \quad (W)$$

wherein $W_2$ and $W_3$ each represents an alkylene group;

c represents an integer of 0 to 3;

X represents —O—, —S— or $—N(R_3)—$; and $R_3$ represents a hydrogen atom, an alkyl group or an aryl group.

2. The processing method as in claim 1, wherein said processing solution having bleaching ability contains ammonium ion at a concentration of not higher than 0.3 mol/l.

3. The processing method as in claim 1, wherein the silver halide emulsion layer of said silver halide color photographic material contains a compound which releases a bleaching accelerator by the reaction thereof with the oxidants of aromatic primary amine color developing agents.

4. The processing method as in claim 1, wherein said iron (III) complex salt is contained at a concentration of 0.05 to 0.16 mol/liter.

5. The processing method as in claim 1, wherein said iron (III) complex salt accounts for at least 50 mol % of the total amount of all bleaching agents in the processing solution.

6. The processing method as in claim 1, wherein said iron (III) complex salt accounts for at least 80 mol % of the total amount of all bleaching agents in the processing solution.

7. The processing method as in claim 1, wherein said aspect ratio is 5 to 30.

8. The processing method as in claim 1, wherein said tabular silver iodobromide grains have a silver iodide content of 1 to 30 mol %.

9. The processing method as in claim 1, wherein said tabular silver iodobromide grains account for at least 80% of the entire projected area of said silver halide grains.

10. The processing method as in claim 1, wherein said processing solution is a bleaching solution.

11. The processing method as in claim 10, wherein said bleaching solution has a pH of 4 to 5.5.

12. The processing method as in claim 1, wherein said $Y_1$ is a phenylene group.

13. The processing method as in claim 1, wherein said $X_1$ is a group represented by $—L_1—A_2$.

14. The processing method as in claim 1, wherein said $X_3$ is a group represented by $—L_4—A_4$.

15. The processing method as in claim 1, wherein said $A_1$, $A_2$, $A_3$, $A_4$ and $A_5$ each is a carboxyl group.

16. The processing method as in claim 1, wherein said $W_1$ is selected from the group consisting of an alkylene group, an alkenylene group, an arylene group, a bivalent heterocyclic group and a bivalent bonding group composed of a combination of two or more thereof.

17. The processing method as in claim 1, wherein c represents 0.

18. The processing method as in claim 1, wherein $W_1$ represents an alkylene group having 2 to 5 carbon atoms.

19. The processing method as in claim 1, wherein $A_1$ represents a carboxyl group or $—S—L_5—COOH$.

20. The processing method as in claim 1, wherein $A_1$ represents a carboxyl group.

* * * * *